US009488410B2

(12) United States Patent
Sawada et al.

(10) Patent No.: US 9,488,410 B2
(45) Date of Patent: Nov. 8, 2016

(54) CALCULATION METHOD AND CALCULATION DEVICE FOR SUBLIMATION INTERFACE TEMPERATURE, BOTTOM PART TEMPERATURE, AND SUBLIMATION RATE OF MATERIAL TO BE DRIED IN FREEZE-DRYING DEVICE

(75) Inventors: Hiroyuki Sawada, Tokyo (JP); Kazunori Tonegawa, Tokyo (JP); Hiroshi Hosomi, Tokyo (JP); Ryouji Sunama, Tokyo (JP)

(73) Assignee: Kyowa Vacuum Engineering, Ltd., Tokyo (JP)

( * ) Notice: Subject to any disclaimer, the term of this patent is extended or adjusted under 35 U.S.C. 154(b) by 612 days.

(21) Appl. No.: 13/984,200

(22) PCT Filed: Feb. 8, 2012

(86) PCT No.: PCT/JP2012/052871

§ 371 (c)(1),
(2), (4) Date: Oct. 10, 2013

(87) PCT Pub. No.: WO2012/108470

PCT Pub. Date: Aug. 16, 2012

(65) Prior Publication Data

US 2014/0026434 A1 Jan. 30, 2014

(30) Foreign Application Priority Data

Feb. 8, 2011 (JP) ..... 2011-025069

(51) Int. Cl.
*F26B 5/06* (2006.01)

(52) U.S. Cl.
CPC ..... *F26B 5/06* (2013.01)

(58) Field of Classification Search
CPC ..... F26B 5/06
USPC ..... 34/284
See application file for complete search history.

(56) References Cited

U.S. PATENT DOCUMENTS 2,507,632 A * 5/1950 Hickman ..... B01D 5/0027 202/185.2
2,765,236 A * 10/1956 Blaine, Jr. ..... A23B 4/037 34/284

(Continued)

FOREIGN PATENT DOCUMENTS

JP 2000-146797 A 5/2000
JP 2004-232965 A 8/2004

(Continued)

OTHER PUBLICATIONS

Milton N, et al.: Evaluation of Manometric Temperature Measurement as a Method of Monitoring Product Temperature During lyophilization, PDA Journal of Pharmaceutical Science and Technology, 51 (1) 7-16 1997.

(Continued)

*Primary Examiner* — Kenneth Rinehart
*Assistant Examiner* — Bao D Nguyen
(74) *Attorney, Agent, or Firm* — Crowell & Moring LLP

(57) ABSTRACT

[Object]

To provide a calculation method and calculation device for an average sublimation interface temperature, bottom part temperature, and sublimation rate of the whole to-be-dried material introduced into a drying chamber of a freeze-drying device without contaminating or collapsing the to-be-dried material.

[Solution]

The present invention is applied to a freeze-drying device that includes a drying chamber DC, a cold trap CT, vacuum adjustment means for adjusting the degree of the vacuum in the drying chamber DC, and a control device CR for automatically controlling the operations of the above elements. The control device CR stores a required relational expression and a calculation program, drives the vacuum adjusting means during a primary drying period of the to-be-dried material to temporarily change the drying chamber's degree of vacuum Pdc in an increasing direction, and calculates the average sublimation interface temperature Ts, bottom part temperature Tb, and sublimation rate Qm of the to-be-dried material during the primary drying period in accordance with the relational expression and with measured data including the drying chamber's degree of vacuum Pdc and the cold trap's degree of vacuum Pdt, which are obtained before and after the temporary change.

6 Claims, 10 Drawing Sheets

(56) References Cited

U.S. PATENT DOCUMENTS 3,178,829 A * 4/1965 Cox ..... F26B 5/06 200/185
3,192,643 A * 7/1965 Antoine Rieutord .... A23C 1/08 34/565
4,353,222 A * 10/1982 Kobayashi ..... A23L 3/44 62/268
4,547,977 A * 10/1985 Tenedini ..... F26B 5/06 165/65
4,780,964 A * 11/1988 Thompson, Sr. ..... F26B 5/06 34/292
5,208,998 A * 5/1993 Oyler, Jr. ..... F26B 5/065 159/4.01
6,122,836 A * 9/2000 Tenedini ..... F26B 5/06 34/287
6,163,979 A * 12/2000 Oetjen ..... F26B 5/06 34/286
6,971,187 B1 * 12/2005 Pikal ..... F26B 5/06 34/285
7,579,032 B2 * 8/2009 Lee ..... A23L 1/097 426/477
7,765,713 B2 * 8/2010 Ehrhard ..... F26B 5/06 34/284
2003/0116027 A1 * 6/2003 Brulls ..... F26B 5/06 99/279
2006/0137212 A1 * 6/2006 Nomine ..... F26B 5/06 34/284
2008/0226770 A1 * 9/2008 Lee ..... A23L 1/2364 426/66
2009/0107000 A1 * 4/2009 Oetjen ..... A23L 3/44 34/284
2009/0304891 A1 * 12/2009 Fujihara ..... A23C 9/13 426/548
2010/0166678 A1 * 7/2010 Iida ..... A61K 8/60 424/49
2012/0076908 A1 * 3/2012 Fujihara ..... A23L 1/09 426/548
2012/0189739 A1 * 7/2012 Rathke ..... A23L 2/60 426/67
2014/0272068 A1 * 9/2014 Prakash ..... A23L 2/60 426/548
2014/0342044 A1 * 11/2014 Bell ..... A23L 2/385 426/72
2015/0110940 A1 * 4/2015 Lee ..... A23G 9/045 426/548

FOREIGN PATENT DOCUMENTS

JP 2011-252654 A 12/2011
WO WO 2008/034855 A2 3/2008

OTHER PUBLICATIONS

International Search Report dated May 22, 2012 w/ partial English translation (five (5) pages).

* cited by examiner

CALCULATION METHOD AND CALCULATION DEVICE FOR SUBLIMATION INTERFACE TEMPERATURE, BOTTOM PART TEMPERATURE, AND SUBLIMATION RATE OF MATERIAL TO BE DRIED IN FREEZE-DRYING DEVICE

TECHNICAL FIELD

The present invention relates to a calculation method and calculation device for a sublimation interface temperature, a bottom part temperature, and a sublimation rate of a material to be dried, which are applied to optimizing and monitoring a drying process in a freeze-drying device for freeze-drying a raw material liquid for foods, pharmaceuticals, or the like until a product having a predetermined moisture content is obtained.

BACKGROUND ART

In general, pharmaceuticals and the like are freeze-dried by using a freeze-drying device, which is automatically controlled by a control device, introducing a large number of trays, vials, or other containers filled with a to-be-dried material into a drying chamber, and drying the to-be-dried material in each container to a predetermined moisture content. In the above-mentioned freeze-drying process for the to-be-dried material, which is performed by the freeze-drying device, it is important for proper monitoring and optimization of the drying process that an average sublimation interface temperature of the whole to-be-dried material filled into a large number of containers be accurately measured. A conventionally known method of measuring the sublimation interface temperature of the to-be-dried material during a primary drying period of the freeze-drying process inserts a thermocouple or other temperature sensor into at least one of the large number of containers introduced into the drying chamber and directly measures the temperature of the to-be-dried material filled into the container. The drying process is monitored by continuously measuring, from the start of freezing, the temperature of a shelf stage (shelf temperature) in the drying chamber in which containers filled with the to-be-dried material are mounted, the degree of vacuum in the drying chamber, and the sublimation interface temperature of the to-be-dried material (product temperature).

However, when the product temperature is measured by the temperature sensor, the following problems occur.

(1) The product temperature measured by the temperature sensor is the temperature of a portion of a to-be-dried material into which a temperature sensing element of the temperature sensor is inserted. This does not represent the product temperature of the whole to-be-dried material introduced into the drying chamber.

(2) As the temperature sensor is not always disposed at the same location, the degree of reproducibility is low.

(3) The degree of supercooling of the to-be-dried material in the container into which the temperature sensor is inserted is decreased by nucleation temperature and ice crystal growth. Therefore, an average ice crystal size increases to reduce the water vapor resistance of a dried layer, thereby increasing the sublimation rate. Further, the to-be-dried material is affected by radiant heat input from a drying chamber wall depending on the position of a shelf on which the container into which the temperature sensor is inserted is mounted. Therefore, the to-be-dried material does not represent the whole to-be-dried material in the containers because it differs in a drying rate, for instance, from a to-be-dried material in a container placed at a location apart from the drying chamber wall.

(4) As described above, the to-be-dried material into which the temperature sensor is inserted exhibits a high drying rate. Therefore, if a point of time at which there is no difference between the product temperature of the to-be-dried material into which the temperature sensor is inserted and the shelf temperature is regarded as the end point of primary drying, it is possible that ice may be left on the to-be-dried material in a container placed at the center of the shelf. Consequently, the to-be-dried material may be introduced into a secondary drying process before being completely sublimated, and collapse (become defective and unrecoverable without being dried to required dryness).

(5) In consideration of work efficiency, the temperature sensor has to be manually set in a container. Meanwhile, as regards the sterile formulation of a pharmaceutical, it is stipulated that a partially stoppered container must be handled in an important process zone. However, according to a regulatory authority, a problem occurs if a person installs the temperature sensor by leaning over a laminar flow of grade A and bending over an array of containers. Consequently, as regards at least the sterile formulation of a pharmaceutical, it is difficult to let a person enter a grade A area in order to set the temperature sensor in its place. At present, regulatory guidelines in various countries also stipulate strict regulations concerning a process of loading a partially stoppered container filled with a medical solution to the shelf of the freeze-drying device. Such regulations point out a risk of causing the partially stoppered container to be contaminated when it is manually transported or transferred to the shelf. Under the above circumstances, a latest technology is adopted to automate a process of transferring the partially stoppered container from a filling machine to the shelf of the freeze-drying device. However, an automatic loading device does not measure the product temperature because it cannot make product temperature measurements on individual containers. In an actual sterile formulation of a pharmaceutical, therefore, the product temperature measurements are made on the individual containers during the validation of three lots at a production start-up stage, and when a required product evaluation is obtained from the results of the measurements, subsequent production is conducted merely by managing parameters indicative of the shelf temperature and the degree of vacuum.

Under the above circumstances, a method called the MTM (Manometric Temperature Measurement) method is conventionally proposed. The MTM method performs calculations on measured values of the other parameters to determine the sublimation interface temperature of the to-be-dried material instead of directly measuring the sublimation interface temperature. This method is applied to a freeze-drying device W that includes a drying chamber DC and a cold trap CT as shown in FIG. 1. The drying chamber DC is a chamber into which the to-be-dried material is introduced. The cold trap CT condenses and traps water vapor generated from the to-be-dried material introduced into the drying chamber DC. The drying chamber DC communicates with the cold trap CT through a main pipe a having a main valve MV. During the primary drying period of the to-be-dried material, the main valve MV is closed for a period of more than 10 seconds at fixed time intervals to measure changes in the degree of vacuum in the drying chamber DC with an absolute vacuum gauge at a measurement rate of 1 second or lower. The sublimation interface temperature Ts and the dried layer water vapor resistance Rp are then calculated from the measured changes in the degree of vacuum (refer to Nonpatent Literature 1).

As described above, when a vacuum freeze-drying device is activated to start a primary drying process with the to-be-dried material introduced into the drying chamber DC, the MTM method periodically closes the main valve MV between the drying chamber DC and the cold trap CT at fixed time intervals to isolate the drying chamber DC from the cold trap CT. This temporarily inhibits the cold trap CT from condensing and trapping the water vapor generated from the to-be-dried material in the drying chamber DC. When the drying chamber DC is isolated from the cold trap CT, the water vapor sublimated from the to-be-dried material rapidly raises the pressure in the drying chamber DC to a sublimation interface pressure of the to-be-dried material. Subsequently, the vacuum pressure in the drying chamber increases with an increase in the product temperature. The average sublimation interface temperature of the to-be-dried material is then calculated from the changes in the degree of vacuum in the drying chamber. The degree of vacuum in the drying chamber needs to be measured with a vacuum gauge b that is capable of measuring an absolute pressure. It is also necessary to collect data at a fast recording speed, that is, within a period of 1 second or shorter.

However, the MTM method has the following two problems.

(1) When the main valve MV is fully closed, the pressure in the drying chamber DC rises to the sublimation interface pressure or higher, thereby raising the sublimation interface temperature to a collapse temperature of the to-be-dried material or higher. Therefore, a dried product may collapse, resulting in unsuccessful freeze drying.

(2) When the MTM method is exercised, the main valve MV needs to be instantaneously opened and closed. However, when a common production machine is used, it takes several minutes to open and close the main valve MV. This complicates the calculation of the sublimation interface temperature. Further, when the main valve MV is opened and closed with a delay, the degree of vacuum in the drying chamber DC further decreases. This also makes the to-be-dried material easily collapsible.

FIG. 2 shows an example of a monitoring result of a freeze-drying process performed by the MTM method. The freeze-drying process was performed by using a 5% water solution of sucrose as the to-be-dried material. The sublimation interface temperature Ts of the to-be-dried material mounted on the shelf of the drying chamber DC was calculated by the MTM method during the primary drying period. Further, for verification purposes, a temperature sensor (thermocouple) was inserted into the to-be-dried material in a vial placed at an end of the shelf and into the to-be-dried material in a vial placed at the center of the shelf in order to measure not only the product temperature Tm (side) at the end of the shelf and the product temperature Tm (center) at the center of the shelf, but also the shelf temperature (Th). As is obvious from FIG. 2, the sublimation interface temperature Ts of the to-be-dried material that was calculated by the MTM method is substantially equal to the product temperature Tm (side) at the end of the shelf and the product temperature Tm (center) at the center of the shelf, which were measured by the temperature sensor. It indicates that the sublimation interface temperature Ts of the to-be-dried material can be accurately measured by using the MTM method.

CITATION LIST

Nonpatent Literature

NONPATENT LITERATURE 1: Evaluation of Manometric Temperature Measurement as a Method of Monitoring Product Temperature During Lyophilization, PDA Journal of Pharmaceutical Science and Technology, 51(1)7-16 (1977)

SUMMARY OF INVENTION

Technical Problem

However, as is obvious from the experimental result shown in FIG. 2, the MTM method decreases the degree of vacuum in the drying chamber DC (increases the pressure in the drying chamber DC) while the main valve MV is closed. Therefore, the sublimation interface temperature Ts of the to-be-dried material rises during such a process, thereby making the to-be-dried material easily collapsible. More specifically, FIG. 2 indicates that, at an initial stage of the primary drying period, the shelf temperature Th was set at −20° C. whereas the sublimation interface temperature of the to-be-dried material, which was calculated by the MTM method, was not higher than −34° C. As the collapse temperature of sucrose is −32° C., the to-be-dried material does not possibly collapse in such a state. However, when the shelf temperature is raised to 0° C. after a lapse of approximately 21 hours from the start of freeze-drying, the sublimation interface temperature of the to-be-dried material, which is calculated by the MTM method, rises to −30° C. FIG. 2 shows that the sublimation interface temperature during the primary drying period can be calculated by the MTM method. However, the MTM method repeatedly closes the main valve MV during the primary drying period as described above. Therefore, the degree of vacuum in the drying chamber DC decreases to raise the product temperature by 1 to 2° C. while the main valve MV is closed. Consequently, if the sublimation interface temperature of the to-be-dried material approaches the collapse temperature of the to-be-dried material while the main valve MV is closed, the to-be-dried material may collapse. In addition, the number of containers whose contents are sublimated increases to decrease the amount of sublimation during a later stage of primary drying and a period of transition from primary drying to secondary drying. Hence, the calculated sublimation interface temperature rapidly lowers during the use of the MTM method. As a result, product temperature changes cannot be monitored during the later stage of primary drying and the period of transition from primary drying to secondary drying.

If a dried product collapses, it cannot be vacuum-dried again so that raw materials are wasted. Particularly, as regards pharmaceuticals whose raw materials are expensive, it is strongly demanded that the collapse of to-be-dried materials be absolutely avoided.

The present invention has been made to solve the above-described problem with conventional technologies. An object of the present invention is to provide a calculation method and calculation device for the average sublimation interface temperature, bottom part temperature, and average sublimation rate of the whole to-be-dried material introduced into a drying chamber of a freeze-drying device without contaminating or collapsing the to-be-dried materials.

Solution to Problem

In order to solve the above problem, according to the present invention, there is provided a calculation method for a sublimation interface temperature, a bottom part temperature, and a sublimation rate of a material to be dried in a freeze-drying device having a drying chamber (DC) into which the to-be-dried material is introduced, a cold trap (CT) for condensing and trapping water vapor generated from the to-be-dried material introduced into the drying chamber (DC), a main pipe (a) for providing communication between the drying chamber (DC) and the cold trap (CT), a main valve (MV) for opening and closing the main pipe (a), vacuum adjustment means for adjusting the degree of vacuum in the drying chamber (DC), vacuum detection means for detecting an absolute pressure in the drying chamber (DC) and an absolute pressure in the cold trap (CT), and a control device (CR) for automatically controlling the operations of the drying chamber (DC), of the cold trap (CT), and of the opening adjustment means, wherein the control device (CR) stores a required relational expression and a calculation program, drives the vacuum adjustment means during a primary drying period of the to-be-dried material to temporarily change the degree of vacuum (Pdc) in the drying chamber (DC) in an increasing direction, and calculates an average sublimation interface temperature, an average bottom part temperature, and the sublimation rate of the to-be-dried material that prevail during the primary drying period in accordance with the relational expression and with measured data including at least the degree of vacuum (Pdc) in the drying chamber (DC) and the degree of vacuum (Pdt) in the cold trap (CT), which are obtained before and after the temporary change.

According to the present invention, there is provided the calculation method for the sublimation interface temperature, the bottom part temperature, and the sublimation rate of the material to be dried as described in the above-mentioned aspect, wherein the main pipe (a) includes an opening adjustment device (C) as the vacuum adjustment means; wherein the relational expression stored in the control device describes the relationship between the sublimation rate (Qm) under water load in a state where the main valve (MV) is fully open, an opening angle (θ) of the opening adjustment device (C), and a main pipe resistance R(θ); and wherein the control device (CR) turns the opening adjustment device (C) at least once in an opening direction during the primary drying period of the to-be-dried material introduced into the drying chamber (DC) to change the degree of vacuum (Pdc) in the drying chamber (DC) in the increasing direction, and calculates the average sublimation interface temperature, the bottom part temperature, and the sublimation rate of the to-be-dried material that prevail during the primary drying period in accordance with measured data about the opening angle (θ) of the opening adjustment device (C), the degree of vacuum (Pdc) in the drying chamber (DC), and the degree of vacuum (Pdt) in the cold trap (CT), which are obtained before and after the opening-direction turning of the opening adjustment device (C).

According to the present invention, there is provided the calculation method for the sublimation interface temperature, the bottom part temperature, and the sublimation rate of the material to be dried as described in the above-mentioned aspect, wherein the drying chamber (DC) includes a vacuum control circuit (f) with a leak control valve (LV) as the vacuum adjustment means; wherein the relational expression stored in the control device describes the relationship between the sublimation rate (Qm) under water load in a state where the main valve (MV) is fully open and a water vapor flow resistance coefficient (Cr) of the main pipe (a); and wherein the control device (CR) closes the leak control valve (LV) at least once during the primary drying period of the to-be-dried material introduced into the drying chamber (DC) to change the degree of vacuum (Pdc) in the drying chamber (DC) in the increasing direction, and calculates the average sublimation interface temperature, the average bottom part temperature, and the sublimation rate of the to-be-dried material that prevail during the primary drying period in accordance with measured data about the degree of vacuum (Pdc) in the drying chamber (DC) and the degree of vacuum (Pdt) in the cold trap (CT), which are obtained before and after the closing of the leak control valve (LV).

According to a aspect of the present invention, there is provided a calculation device for a sublimation interface temperature, a bottom part temperature, and a sublimation rate of a material to be dried in a freeze-drying device having a drying chamber (DC) into which the to-be-dried material is introduced, a cold trap (CT) for condensing and trapping water vapor generated from the to-be-dried material introduced into the drying chamber (DC), a main pipe (a) for providing communication between the drying chamber (DC) and the cold trap (CT), a main valve (MV) for opening and closing the main pipe (a), vacuum adjustment means for adjusting the degree of vacuum in the drying chamber (DC), vacuum detection means for detecting an absolute pressure in the drying chamber (DC) and an absolute pressure in the cold trap (CT), and a control device (CR) for automatically controlling the operations of the drying chamber (DC), of the cold trap (CT), and of the opening adjustment means; wherein the control device (CR) is a sequencer (PLC) or a personal computer (PC) that stores a required relational expression and a calculation program; and wherein the control device (CR) drives the vacuum adjustment means during a primary drying period of the to-be-dried material to temporarily change the degree of vacuum (Pdc) in the drying chamber (DC) in an increasing direction, and calculates an average sublimation interface temperature, an average bottom part temperature, and the sublimation rate of the to-be-dried material that prevail during the primary drying period in accordance with the relational expression and with measured data including at least the degree of vacuum (Pdc) in the drying chamber (DC) and the degree of vacuum (Pdt) in the cold trap (CT), which are obtained before and after the temporary change.

According to the present invention, there is provided the calculation device for the sublimation interface temperature, the bottom part temperature, and the sublimation rate of the material to be dried as described in the above-mentioned aspect, wherein the main pipe (a) includes an opening adjustment device (C) as the vacuum adjustment means; wherein the relational expression stored in the control device (CR) describes the relationship between the sublimation rate (Qm) under water load in a state where the main valve (MV) is fully open, an opening angle (θ) of the opening adjustment device (C), and a main pipe resistance R(θ); and wherein the control device (CR) turns the opening adjustment device (C) at least once in an opening direction during the primary drying period of the to-be-dried material introduced into the drying chamber (DC) to change the degree of vacuum (Pdc) in the drying chamber (DC) in the increasing direction, and calculates the average sublimation interface temperature, the bottom part temperature, and the sublimation rate of the to-be-dried material that prevail during the primary drying period in accordance with measured data about the opening angle (θ) of the opening adjustment device (C), the degree of vacuum (Pdc) in the drying chamber (DC), and the degree of vacuum (Pdt) in the cold trap (CT), which are obtained before and after the opening-direction turning of the opening adjustment device (C).

According to the present invention, there is provided the calculation device for the sublimation interface temperature, the bottom part temperature, and the sublimation rate of the material to be dried as described in the above-mentioned aspect, wherein the drying chamber (DC) includes a vacuum control circuit (f) with a leak control valve (LV) as the vacuum adjustment means; wherein the relational expression stored in the control device (CR) describes the relationship between the sublimation rate (Qm) under water load in a state where the main valve (MV) is fully open and a water vapor flow resistance coefficient (Cr) of the main pipe (a); and wherein the control device (CR) closes the leak control valve (LV) at least once during the primary drying period of the to-be-dried material introduced into the drying chamber (DC) to change the degree of vacuum (Pdc) in the drying chamber (DC) in the increasing direction, and calculates the average sublimation interface temperature, the average bottom part temperature, and the sublimation rate of the to-be-dried material that prevail during the primary drying period in accordance with measured data about the degree of vacuum (Pdc) in the drying chamber (DC) and the degree of vacuum (Pdt) in the cold trap (CT), which are obtained before and after the closing of the leak control valve (LV).

Advantageous Effects of Invention

The present invention drives the vacuum adjustment means during the primary drying period of the to-be-dried material to temporarily change the degree of vacuum in the drying chamber and calculates the average sublimation interface temperature, the average bottom part temperature, and the sublimation rate of the to-be-dried material that prevail during the primary drying period in accordance with the measured data including at least the degree of vacuum in the drying chamber and the degree of vacuum in the cold trap, which are obtained before and after the temporary change. Therefore, the degree of vacuum in the drying chamber changes to increase above a vacuum control value when the measured data is collected. As this decreases the sublimation interface temperature, it is possible to completely avoid the risk of collapsing the to-be-dried material.

DESCRIPTION OF EMBODIMENTS

The calculation method and calculation device for a sublimation interface temperature, a bottom part temperature, and a sublimation rate of a to-be-dried material that are applied to a freeze-drying device in accordance with the present invention will now be described in conjunction with specific embodiments.

First Embodiment

The calculation method and calculation device according to a first embodiment are applied to a freeze-drying device of a flow path opening vacuum control type that includes an opening adjustment device (damper) for adjusting the degree of vacuum in a drying chamber. The opening adjustment device is disposed in a main pipe that connects the drying chamber to a cold trap.

Figure 1:
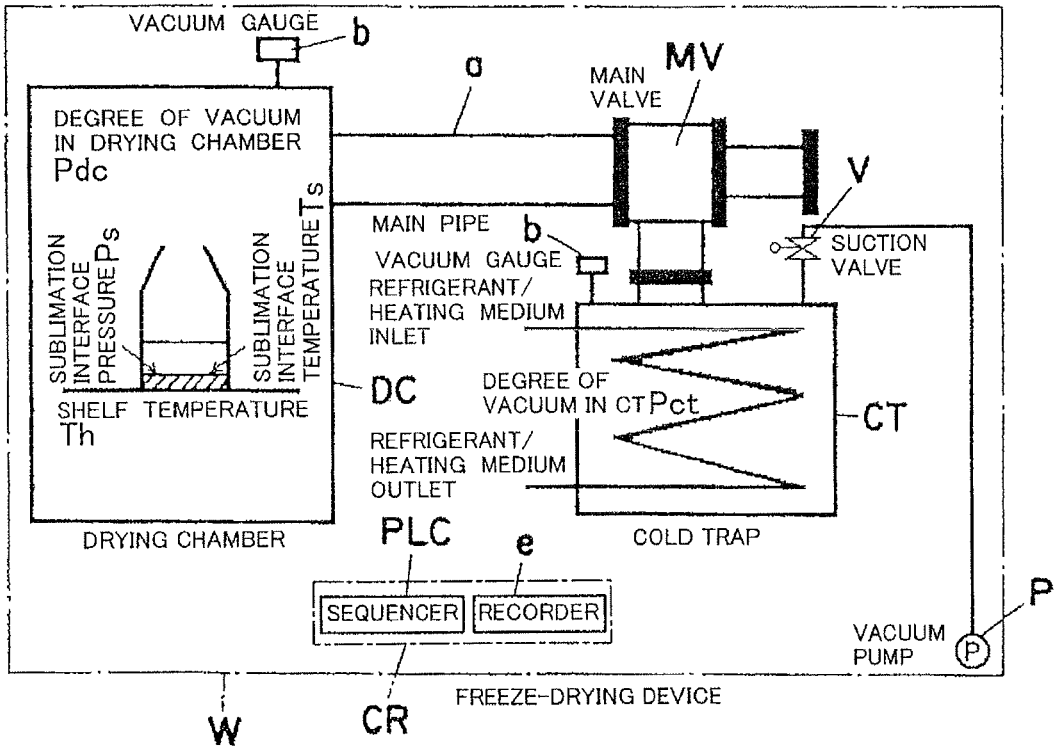
FIG. 1 is a diagram illustrating the configuration of a freeze-drying device that is applied to a situation where a sublimation interface temperature of a to-be-dried material is calculated by a conventional MTM method.
Figure 2:
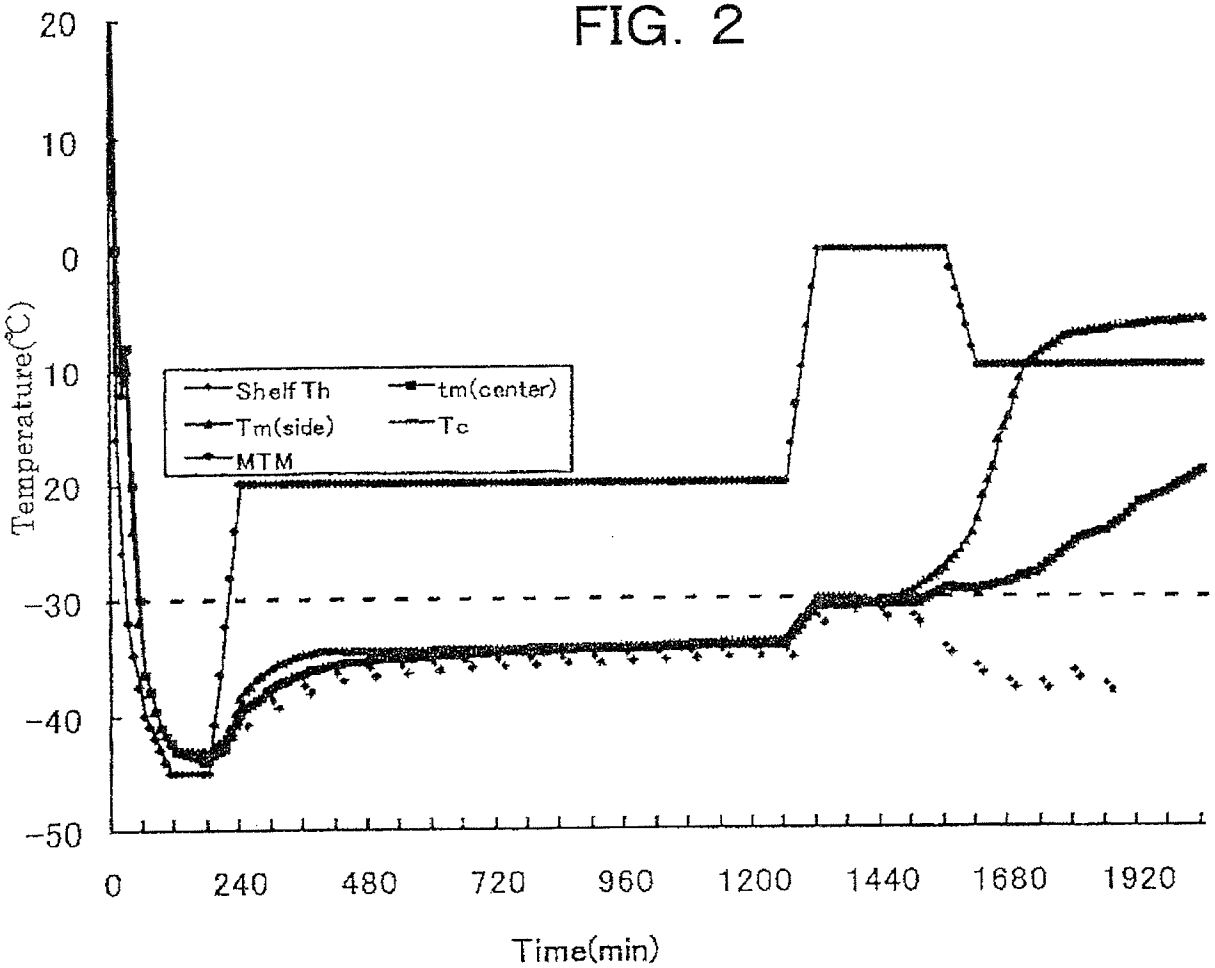
FIG. 2 is a graph illustrating the problems of the MTM method.
Figure 3:
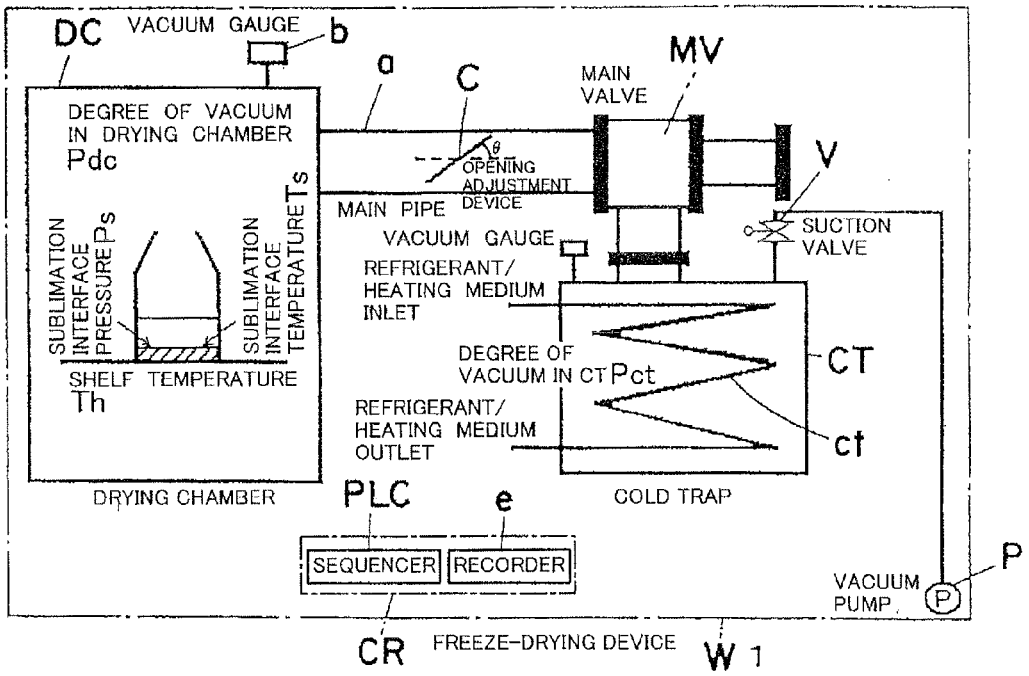
FIG. 3 is a diagram illustrating the configuration of a freeze-drying device to which a calculation method and calculation device for a flow path opening vacuum control system according to a first embodiment are applied.

More specifically, as shown in FIG. 3, a vacuum-drying device W1 according to the first embodiment mainly includes a drying chamber DC into which a to-be-dried material is introduced, a cold trap CT for condensing and trapping water vapor generated from the to-be-dried material introduced into the drying chamber DC by using a trap coil Ct, a main pipe a for providing communication between the drying chamber DC and the cold trap CT, a main valve MV for opening and closing the main pipe a, a damper-type opening adjustment device C disposed in the main pipe a, a suction valve V annexed to the cold trap CT, a vacuum pump P connected to the suction valve V, a vacuum gauge b for detecting an absolute pressure in the drying chamber DC and an absolute pressure in the cold trap CT, and a control device CR for automatically controlling the operations of the above-mentioned elements. In the present embodiment, a control panel having a sequencer PLC and a recorder e is used as the control device CR. The sequencer PLC stores in advance a required calculation program and a relational expression that describes the relationship between the sublimation rate Qm under water load in a state where the main valve MV is fully open, an opening angle θ of the opening adjustment device C, and a main pipe resistance R(θ). A personal computer in which the above calculation program and relational expression are recorded may be used as the control device CR in place of the control panel. Further, a differential vacuum gauge for detecting the difference between the absolute pressure in the drying chamber DC and the absolute pressure in the cold trap CT may be provided in place of the vacuum gage b for detecting the absolute pressure in the drying chamber DC and in the cold trap CT. The opening angle θ is the angle of rotation of the opening adjustment device C from a fully-open state (0°).

Figure 4:
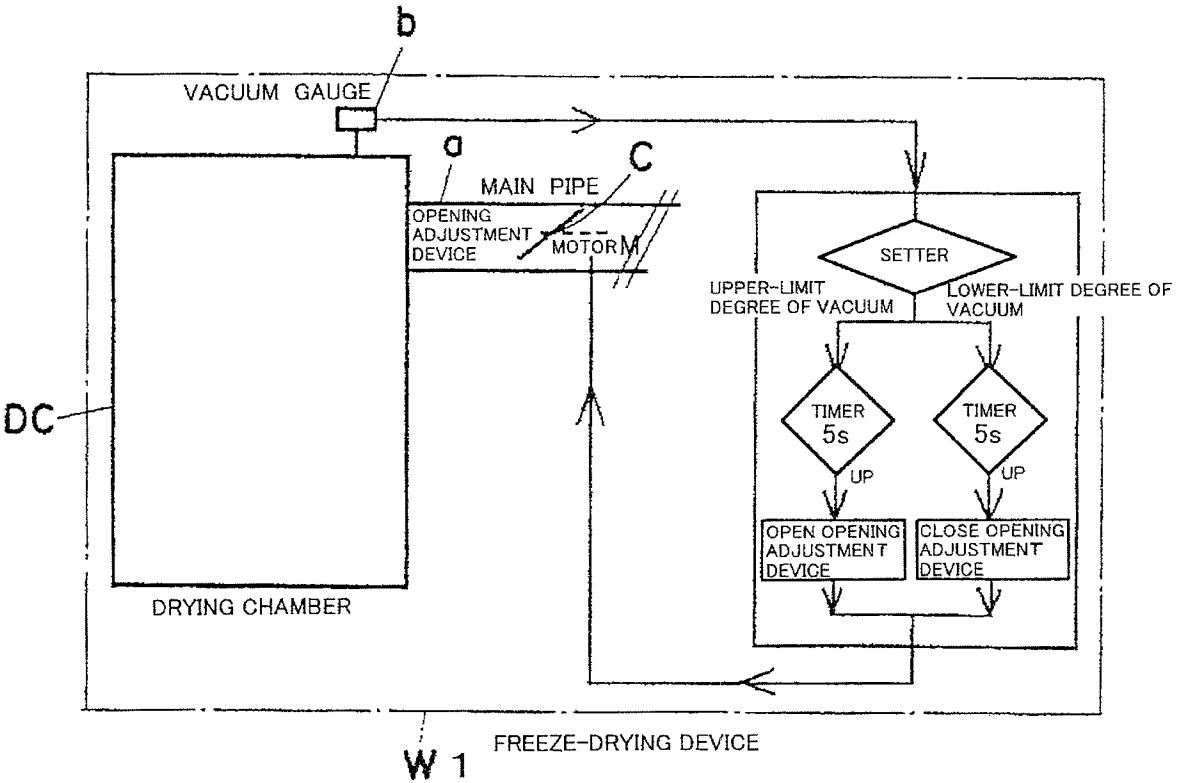
FIG. 4 is a flowchart illustrating the flow path opening vacuum control system.

When an average sublimation interface temperature Ts, average bottom part temperature Tb, and sublimation rate Qm of the to-be-dried material introduced into the drying chamber DC during a primary drying period are to be calculated, the control device CR turns the opening adjustment device C at least once in an opening direction as shown in FIG. 4 to change the degree of vacuum in the drying chamber DC in an increasing direction during each operation and obtains measured data about the opening angle θ of the opening adjustment device C, the degree of vacuum Pdc in the drying chamber DC, and the degree of vacuum Pdt in the cold trap CT, which prevail before and after the opening-direction turning of the opening adjustment device C.

<Method of Calculating the Average Sublimation Interface Temperature Ts>

When the degree of vacuum Pdc in the drying chamber DC is changed in the increasing direction, the average sublimation interface temperature Ts of the whole to-be-dried material can be calculated as follows from the measured data about the change in the degree of vacuum.

First of all, the flow rate (sublimation rate) Qm of water vapor that moves from a sublimation interface into the drying chamber through a dried layer of the to-be-dried material is determined by the following equation when a sublimation interface pressure is Ps (Pa), the degree of vacuum in the drying chamber is Pdc (Pa), and the water vapor transfer resistance of the dried layer of the to-be-dried material is Rp (Kpa−S/Kg).

$$Qm=dm/dt=(Ps-Pdc)/Rp$$

If, before the degree of vacuum Pdc in the drying chamber DC is changed in the increasing direction, the water vapor flow rate is Qm1, the sublimation interface pressure is Ps1, and the degree of vacuum in the drying chamber DC is Pdc1, and if, after the degree of vacuum Pdc in the drying chamber DC is changed in the increasing direction, the water vapor flow rate is Qm2, the sublimation interface pressure is Ps2, and the degree of vacuum in the drying chamber DC is Pdc2, the water vapor flow rate Qm1 before the degree of vacuum Pdc in the drying chamber DC is changed in the increasing direction is expressed by the following equation.

$$Qm1=3.6\times(Ps1-Pdc1)/Rp$$

The wafer vapor flow rate Qm2 after the degree of vacuum Pdc in the drying chamber DC is changed in the increasing direction is expressed by the following equation.

$$Qm2=3.6\times(Ps2\times Pdc2)/Rp$$

As Pdc2 is lower than Pdc1, the sublimation interface temperature Ts decreases after the degree of vacuum Pdc in the drying chamber DC is changed.

In other words, if the ratio between the sublimation rate Qm before the degree of vacuum Pdc in the drying chamber DC is changed in the increasing direction and the sublimation rate Qm after the degree of vacuum Pdc in the drying chamber DC is changed in the increasing direction is C, the following equation is obtained from the above equation.

$$C=Qm1/Qm2=(Ps1-Pdc1)/(Ps2-Pdc2)$$

If Ps1=Ps and Ps2=Ps−ΔPs, the following equations are obtained.

$$C=(Ps-Pdc1)/(Ps-\Delta Ps-Pdc2)$$

$$Ps-C\times Ps=Pdc1-C\times(\Delta Ps+Pdc2)$$

$$Ps=[C\times(Pdc2+\Delta Ps)-Pdc1]/(C-1)$$

where ΔPs is a decrease in the sublimation interface pressure that is caused when the sublimation interface temperature decreases while the degree of vacuum Pdc in the drying chamber DC is being changed in the increasing direction.

Further, when the Clausius-Clapeyron equation LnPs=28.91−6144.96/Ts is differentiated, the equation $\Delta Ps/Ps=6144.96\times\Delta Ts/Ts^2$ is obtained. From this equation, the average sublimation interface temperature Ts=6144.96/(28.911−LnPs)−273.15 is obtained.

As far as the sublimation rates Qm1, Qm2, which prevail before or after the degree of vacuum Pdc in the drying chamber DC is changed in the increasing direction, are accurately measured at fixed intervals during the primary drying period, the above calculation equations make it possible to calculate the average sublimation interface temperature of the whole to-be-dried material.

<Method of Calculating the Average Bottom Part Temperature Tb>

The average bottom part temperature Tb of the whole to-be-dried material during the primary drying period and the period of transition from primary drying to secondary drying can be calculated as follows.

First of all, the amount of heat input Qh from a shelf to the bottom of a container due to gaseous conduction is calculated by the following equation.

$$Qh=Ae\times K\times(Th-Tb)$$

where Ae is an effective heat transfer area ($m^2$), K is a coefficient of heat transfer from the shelf to the bottom of the container due to gaseous conduction, Th is a shelf temperature)(C.°), and Tb is a bottom part temperature)(C.°).

The effective heat transfer area Ae can be calculated from the equation Ae=2/(1/Av+1/At).

The coefficient K ($W/m^{2\circ}$ C.) of heat transfer from the shelf to the bottom of the container due to gaseous conduction is K=16.86/(δ+2.12×29×0.133/Pdc).

In the equation for calculating the effective heat transfer area Ae, Av is the bottom part area ($m^2$) of the container and At is a tray frame area ($m^2$).

The container bottom part area Av can be calculated from the equation $Av=\pi/4\times n1\times d^2$ (n1 is the number of vials and d is a vial diameter). The tray frame area At can be calculated from the equation At=n2×W×L (n2 is the number of frames, W is a frame width, and L is a frame length).

In the equation for calculating the coefficient K of heat transfer from the shelf to the bottom of the container due to gaseous conduction, δ is a gap between the bottoms of containers and expressed in units of mm.

Meanwhile, the amount of radiant heat input Qr from a drying chamber wall to all containers is determined by the following equation.

$$Qr=5.67\times\epsilon\times Ae\times[(Tw/100)^4-(Tb/100)^4]$$

where ϵ is a radiation coefficient, Tw is a drying chamber wall temperature, and Tb is the bottom part temperature.

Further, the amount of radiant heat input Qr from the drying chamber wall to all containers can be approximately calculated from the following equation.

$$Qr=Ae\times Kr\times(Tw-Tb)$$

where Kr is an equivalent heat transfer coefficient provided by the radiant heat input and can be approximated at 0.7 $W/m^{2\circ}$ C. in a test machine and at 0.2 $W/m^{2\circ}$ C. in a production machine.

From the relationship between the amount of heat input and the latent heat of sublimation, the following equation is established.

$$Qm\times\Delta Hs=3.6\times[Ae\times K\times(Th-Tb)+Ae\times Kr\times(Tw-Tb)]$$

where ΔHs the latent heat of sublimation and equal to 2850 KJ/Kg.

The average bottom part temperature of the to-be-dried material can be calculated from the following equation.

$$Tb=[K\times Th+Kr\times Tw-(Qm\times \Delta Hs)/(3.6\times Ae)]/(K+Kr)$$

Consequently, when the sublimation rate Qm is measured during the primary drying period and the period of transition from primary drying to secondary drying, the above calculation equations make it possible to calculate the average bottom part temperature Tb of the whole to-be-dried material.

<Method of Calculating the Sublimation Rate Qm>

The sublimation rate Qm is calculated from the degree of vacuum Pdc in the drying chamber and the degree of vacuum Pct in the cold trap, which are respectively measured with a vacuum gauge b annexed to the drying chamber DC of the freeze-drying device W1 and with a vacuum gauge b annexed to the cold trap CT. Using this method eliminates the necessity of providing an expensive measuring instrument other than the vacuum gauge. Therefore, the sublimation rate Qm can be calculated easily at a low cost.

The method of calculating the sublimation rate Qm in accordance with the first embodiment will now be described.

As described earlier, the water vapor sublimated from the sublimation interface of the to-be-dried material flows from the drying chamber DC to the cold trap CT through the main pipe a and is condensed and trapped by the trap coil Ct. When flow path opening vacuum control is exercised, Pct/Pdc<0.53. Hence, the flow of water vapor in the main pipe a is a jet flow. Therefore, when the main pipe resistance is R, the rate Qm of sublimation from the to-be-dried material can be calculated from the following equation.

$$Qm=3.6\times Pdc/R$$

If, in the above instance, the rate of sublimation from the to-be-dried material, the degree of vacuum in the drying chamber, and the main pipe resistance before the degree of vacuum Pdc in the drying chamber DC is changed in the increasing direction are Qm1, Pdc1, and R(θ1), respectively, and if the rate of sublimation from the to-be-dried material, the degree of vacuum in the drying chamber, and the main pipe resistance after the degree of vacuum Pdc in the drying chamber DC is changed in the increasing direction are Qm2, Pdc2, and R(θ2), respectively, the following equations are obtained.

$$Qm1=3.6\times Pdc1/R(\theta 1)$$

$$Qm2=3.6\times Pdc2/R(\theta 2)$$

The main pipe resistance R is determined by measuring or calculating the amount of sublimation from the to-be-dried material that occurs under water load. When the main pipe resistance R is determined, the sublimation rate Qm can be determined from measured data about the degree of vacuum Pdc in the drying chamber and the degree of vacuum Pct in the cold trap.

More specifically, when the freeze-drying device W1 shown in FIG. 4 is activated with the to-be-dried material introduced into the drying chamber DC to perform a drying process with the shelf temperature set at Th and with the degree of vacuum Pdc in the drying chamber DC set to a control value with the opening adjustment device C, the opening adjustment device C is rotated to increase the degree of vacuum in the drying chamber DC at fixed time intervals (at intervals of 0.5 or 1 hour) during the primary drying period of the to-be-dried material. The opening angle θ of the opening adjustment device C, the degree of vacuum Pdc in the drying chamber DC, and the degree of vacuum Pct in the cold trap CT are recorded with the recorder e before and after the rotation of the opening adjustment device C. The recorded measured data is acquired by the sequencer (PLC). The following steps are then performed in accordance with the calculation program stored in the sequencer (PLC) to calculate the average sublimation interface temperature Ts, the average bottom part temperature Tb, and the sublimation rate Qm of the whole to-be-dried material.

(1) The pressure difference ΔP between the degrees of vacuum Pdc1, Pdc2 in the drying chamber and between the degrees of vacuum Pct1, Pct2 in the cold trap that are determined before or after the degree of vacuum in the drying chamber DC is changed in the increasing direction is calculated.

(2) The main pipe resistance R1, R2 before and after the degree of vacuum in the drying chamber DC is changed in the increasing direction is calculated from the relationship between the main pipe resistance R(θ) measured under water load and the opening angle θ of the opening adjustment device C.

(3) When Pct/Pdc<0.53, that is, when the flow of water vapor in the main pipe a is a jet flow, the equations Qm1=3.6×Pdc1/R1, Qm2=3.6×Pdc2/R2, and C=Qm1/Qm2 are calculated.

(4) In accordance with the results of the above calculations, the sublimation interface pressure Ps=[C×(Pdc2+ΔPs)−Pdc1]/(C−1) is calculated. ΔPs is a decrease in the sublimation interface pressure due to a decrease in the sublimation interface temperature that occurs when the opening adjustment device C is opened. Lips is determined, as explained earlier, when the sublimation interface temperature decrease ΔTs caused by opening the opening adjustment device C is substituted into the equation $\Delta Ps/Ps=6144.96\times \Delta Ts/Ts^2$, which is obtained by differentiating the Clausius-Clapeyron equation LnPs=28.91−6144.96/Ts.

(5) A constant of ice is substituted into the Clausius-Clapeyron equation to calculate the sublimation interface temperature Ts=6144.96/(28.911−LnPs)−273.15.

(6) The sublimation rate Qm (Kg/hr)=3.6×Pdc1/R1 is calculated.

(7) The bottom part temperature Tb=[K×Th+Kr×Tw−(Qm×ΔHs)/(3.6×Ae)]/(K+Kr) is calculated.

In the freeze-drying device W1 of the flow path opening vacuum control type, the main pipe resistance R(θ) of water vapor flowing through the opening adjustment device C and the main pipe a for providing communication between the drying chamber DC and the cold trap CT is expressed by the equation R(θ)=(Pdc−Pct)/Qm. Further, the flow of water vapor is a jet flow when Pct/Pdc<0.53. Therefore, the main pipe resistance R(θ) can be calculated by the equation R(θ)=Pdc/Qm. The method of calculation is described below.

(1) From the pressure drop viscous flow calculation equation $Pdc-P1=Cr\times\rho\times u^2/2$, the resistance R1(θ) at the inlet of the main pipe a and in the main valve MV and main pipe a can be calculated by the equations Pdc−P1=R1(θ)×Qm and $R1(\theta)=Cr\times R\times T/(2\times Pdc\times M\times A0^2)\times Qm$.

(2) As regards the resistance R2(θ) of the opening adjustment device C, a jet flow results when the pressure ratio Pct/P1 across the opening adjustment device C is 0.53 or less. Therefore, the calculation equation for the jet flow is Qm=ρ×A'×u'.

where u' is local sound velocity and equal to $(K\times R\times T/M)^{1/2}$, and A' is a contraction area and equal to 0.6 to 0.7×A.

Thus, if $R2(\theta)=(R\times T/(K\times M))^{1/2}/A'$, the calculation equation for the jet flow can be rewritten as $Qm=P1\times A'\times[K\times M/(R\times T)]^{1/2}=P1/R2(\theta)$.

(3) Meanwhile, the main pipe resistance $R(\theta)$ is expressed by the following equation.

$$R(\theta) = R1(\theta) + R2(\theta)$$

$$= [[CO + (R2(\theta)/2)^2]^{1/2} + R2(\theta)/2$$

where $CO=Cr\times R\times T/(2\times Pdc\times M\times A0^2)=3408.65$, and $R2(e)=\cdot 2223.7/A$.

If D is the inside diameter of the main pipe a, d1 is the diameter of the opening adjustment device C, and t is the thickness of the opening adjustment device C, the cross-sectional area $A(cm^2)$ of the opening adjustment device C is calculated by the equation $A=0.01\times(\pi\times D^2/4-d1\times t\times\cos\theta-n\times d1^2/4\times\sin\theta)$.

Calculation results obtained in the above case are shown in Table 1 below.

TABLE 1

Results of calculation of main pipe resistance R(θ)

| Angle θ | Cross-sectional area A ($cm^2$) | Opening resistance R2 (kPa · s/kg) | Main pipe resistance R(θ) (kPa · s/kg) |
|---|---|---|---|
| 0 | 176.90 | 25.14 | 72.29 |
| 27.6 | 95.55 | 46.55 | 86.13 |
| 41.7 | 60.50 | 73.51 | 105.74 |
| 51.4 | 40.51 | 109.79 | 135.03 |
| 56.5 | 31.58 | 140.82 | 161.88 |
| 64.6 | 19.87 | 223.82 | 238.13 |
| 68 | 15.90 | 279.65 | 291.35 |
| 71.9 | 12.07 | 368.41 | 377.44 |
| 74.4 | 10.03 | 443.53 | 451.09 |
| 77 | 8.25 | 539.25 | 545.5 |
| 90 | 4.74 | 937.51 | 941.13 |

<Derivation of a Relational Expression Between the Opening Angle θ of the Opening Adjustment Device C and the Main Pipe Resistance R(θ)>

Before the sublimation interface temperature Ts and the sublimation rate Qm are to be calculated, the sublimation rate Qm (Kg/hr), the degree of vacuum Pdc in the drying chamber, and the degree of vacuum Pct in the cold trap are measured under water load to obtain the relational expression between the opening angle θ of the opening adjustment device C and the main pipe resistance R(θ). The method is to mount a product temperature sensor on the bottom part of a tray, pour water into the tray, freeze to a temperature of −40° C., set the shelf temperature during the primary drying period, exercise control to sequentially change the degree of vacuum in the drying chamber from 26.7 Pa to 6.7 Pa, measure the shelf temperature Th and the bottom part temperature Tb, record the pressure Pdc in the chamber and the CT pressure Pct by using an absolute vacuum gauge, and also measure the opening angle θ of the opening adjustment device C at each vacuum control value.

The sublimation rate resistance Qm (Kg/hr) can be determined by two different methods. One method is to determine the amount of sublimation from the difference between the weight of the to-be-dried material before sublimation and the weight of the to-be-dried material after sublimation. The other method is to make an analysis in accordance with a calculated amount of heat input. When the analysis is to be made, the method calculates the coefficient α of heat transfer from the shelf to the tray bottom part in accordance with the degree of vacuum Pdc in the drying chamber DC, calculates the amount of heat flow to the tray bottom part by using the equation $Q=A1\times\alpha\times(Th-Tb)$, and determines the sublimation rate Qm from the equation $Qm=Q/2850$ as the latent heat of sublimation of ice is 2850 KJ/Kg. This makes it possible to obtain the relational expression between the opening angle θ of the opening adjustment device C and the main pipe resistance R(θ).

Subsequently, as far as the opening angle θ of the opening adjustment device C, the degree of vacuum Pdc in the drying chamber DC, and the degree of vacuum Pct in the cold trap CT are measured and recorded when the to-be-dried material is freeze-dried in accordance with a freeze-drying program, the average sublimation interface temperature Ts, the average bottom part temperature Tb, and the sublimation rate Qm during the whole primary drying period can be monitored from the above-mentioned relational expression between the opening angle θ of the opening adjustment device C and the main pipe resistance R(θ), which is derived from a water load measurement, without measuring the product temperature of each container.

First Embodiment

The calculation method and calculation device for the sublimation interface temperature Ts and the sublimation rate Qm of the to-be-dried material that are applied to the freeze-drying device of the flow path opening vacuum control type in accordance with the first embodiment will now be described in further detail.

<Derivation of the Relational Expression Between the Opening Angle of the Opening Adjustment Device and the Main Pipe Resistance>

First of all, a water load test was conducted to obtain the relational expression between the opening angle θ of the opening adjustment device C and the main pipe resistance R(θ). A tray filled with water was introduced into the drying chamber DC of the freeze-drying device W1, and a predetermined drying process was started under the control of the control device CR. The water in the tray was frozen to a temperature of −45° C. The shelf temperature Th was set to −20° C. during the primary drying period. Control was exercised to set the degree of vacuum Pdc in the drying chamber DC to 4 Pa, 6.7 Pa, 10 Pa, 13.3 Pa, 20 Pa, 30 Pa, 40 Pa, and 60 Pa in sequence. Each degree of vacuum was maintained for three hours. The water load test was conducted on a total of eight cases. In the water load test on each of the eight cases, the opening angle θ of the opening adjustment device C, the shelf temperature Th, the ice temperature Tb of the tray bottom part, the degree of vacuum Pdc in the drying chamber DC, and the degree of vacuum Pct in the cold trap CT were measured and recorded.

Figure 5:
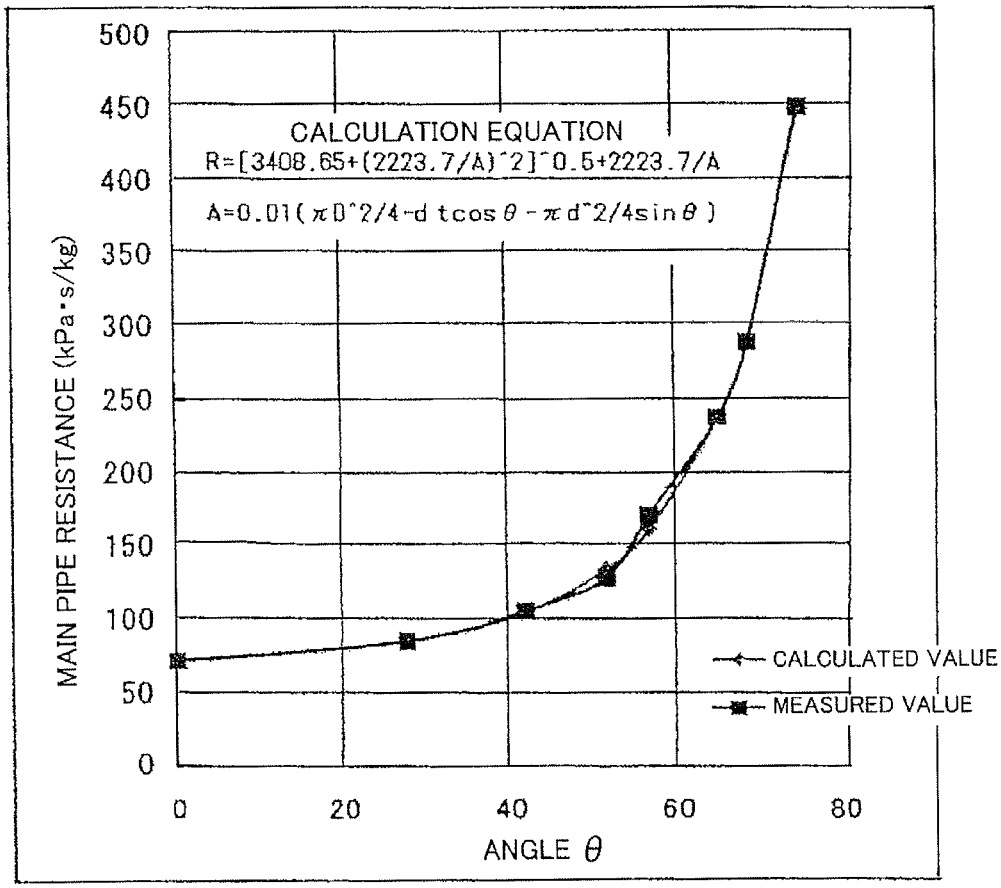
FIG. 5 is a graph illustrating the water-load-dependent relationship between the opening θ of an opening adjustment device and a main pipe resistance R that is determined by the calculation method and calculation device for the flow path opening vacuum control system according to the first embodiment.

The sublimation rate Qm (Kg/h) of ice was determined by measuring the amount of sublimation and performing calculations on the amount of heat input to obtain the relational expression between the opening angle θ of the opening adjustment device C and the main pipe resistance R(θ). Table 2 and FIG. 5 show the relationship between the opening angle θ of the opening adjustment device C and the calculated main pipe resistance R(θ) and the relationship between the opening angle θ of the opening adjustment device C and the measured main pipe resistance R(θ).

TABLE 2

| Comparison between calculated value and measured value of main pipe resistance R(θ) | | |
|---|---|---|
| Angle | Main pipe resistance R(θ) | |
| θ | Calculated value | Measured value |
| 0 | 72.29 | 72.57 |
| 27.6 | 86.13 | 85.75 |
| 41.7 | 105.74 | 106.19 |
| 51.4 | 135.03 | 128.68 |
| 56.5 | 161.88 | 171.92 |
| 64.6 | 238.13 | 238.65 |
| 68 | 291.35 | 290.01 |
| 74.4 | 451.09 | 451.55 |

Next, an equation for calculating the main pipe resistance R(θ) and an equation for calculating the cross-sectional area A ($cm^2$) of the opening adjustment device C were determined as follows from FIG. 5.

$$R(\theta)=[3408.65+(2223.7/A)^2]^{1/2}+2223.7/A$$

$$A=0.01\times(\pi\times D^2/4-d1\times t\times\cos\theta-\pi\times d1^2/4\times\sin\theta)$$

where D is the inside diameter of the main pipe a, d1 is the diameter of the opening adjustment device C, and t is the thickness of the opening adjustment device C.

When the water load test is conducted by performing the above procedure, the relational expression between the opening angle θ of the opening adjustment device C, the main pipe resistance R(θ), and the sublimation rate Qm is obtained.

<Calculation of the Average Sublimation Interface Temperature Ts, the Product Temperature Tb, and the Sublimation Rate Qm>

Next, a freeze-drying test was conducted with an actual load to calculate the average sublimation interface temperature of the whole to-be-dried material. Mannitol (molecular formula: $C_6H_{14}O_6$) was used as the to-be-dried material. A total of 660 vials into which a 10% water solution of mannitol was dispensed were introduced into the drying chamber DC of the freeze-drying device W1. A predetermined drying process was started under the control of the control device CR. In order to verify the adequacy of the calculation device and calculation method according to the present invention, a product temperature sensor was inserted into three vials placed at the center of the shelf to measure the product temperature of the to-be-dried material (mannitol) dispensed into the vials. The solution was frozen for 3 hours at −45° C. The shelf temperature Th was set to −10° C. during the primary drying period. Further, the opening angle θ of the opening adjustment device C was adjusted so that the to-be-dried material was freeze-dried while the degree of vacuum Pdc in the drying chamber DC was 13.3 Pa. During the primary drying period, the opening angle θ of the opening adjustment device C was turned in the opening direction for 120 seconds at 30-minute intervals. The degrees of vacuum Pdc1, Pdc2 in the drying chamber DC, the opening angles θ1, θ2 of the opening adjustment device C, the cross-sectional areas A1, A2 of the main pipe, the main pipe resistances R1, R2, and the sublimation rates Qm1, Qm2, which prevailed before or after the change in the opening angle θ, as well as the ratio C between the sublimation rates Qm1, Qm2, the sublimation interface pressure Ps, the sublimation interface temperature Ts, and the actual product temperature Tm were measured or calculated and recorded. Table 3 shows the measurement/calculation results.

TABLE 3

| Results of measurements of average sublimation interface temperature Ts during flow path opening vacuum control (2010.11.09-10 Mannitol 10% 3 mL/Vial Th = −10° C. P = 13.3 Pa) | | | | | | | | |
|---|---|---|---|---|---|---|---|---|
| Time | Drying chamber Vacuum(Pa) | | Angle | | Cross-sectional area($cm^2$) | | Main pipe resistance (KPas/Kg) | |
| (hr) | P1(0 s) | P2(120 s) | 01(0 s) | 02(120 s) | A1(0 s) | A2(120 s) | R1(0 s) | R2(120 s) |
| 0.5 | 13.42 | 7.87 | 70.794 | 57.195 | 13.08 | 30.46 | 349.78 | 166.50 |
| 1 | 13.31 | 7.53 | 70.794 | 57.195 | 13.08 | 30.46 | 349.78 | 166.50 |
| 1.5 | 13.26 | 7.26 | 71.37 | 57.78 | 12.55 | 29.53 | 363.84 | 170.61 |
| 2 | 13.26 | 7.14 | 71.91 | 58.266 | 12.06 | 28.76 | 377.71 | 174.18 |
| 2.5 | 13.32 | 7.03 | 72.396 | 58.806 | 11.64 | 27.93 | 390.79 | 178.34 |
| 3 | 13.26 | 6.86 | 72.783 | 59.193 | 11.31 | 27.34 | 401.62 | 181.44 |
| 3.5 | 13.32 | 6.70 | 73.224 | 59.589 | 10.95 | 26.75 | 414.43 | 184.72 |
| 4 | 13.38 | 6.70 | 73.611 | 59.976 | 10.64 | 26.17 | 426.09 | 188.04 |
| 4.5 | 13.38 | 6.63 | 73.908 | 60.318 | 10.40 | 25.67 | 435.30 | 191.07 |
| 5 | 13.32 | 6.52 | 74.349 | 60.705 | 10.07 | 25.11 | 449.42 | 194.62 |
| 5.5 | 13.26 | 6.47 | 74.637 | 61.002 | 9.85 | 24.69 | 458.92 | 197.42 |
| 6 | 13.38 | 6.42 | 74.934 | 61.29 | 9.63 | 24.28 | 468.96 | 200.21 |
| 6.5 | 13.32 | 6.30 | 75.177 | 61.632 | 9.46 | 23.80 | 477.36 | 203.62 |
| 7 | 13.38 | 6.30 | 75.519 | 61.875 | 9.22 | 23.46 | 489.45 | 206.11 |
| 7.5 | 13.38 | 6.24 | 75.708 | 62.118 | 9.09 | 23.13 | 496.27 | 208.65 |
| 8 | 13.38 | 6.24 | 76.005 | 62.415 | 8.89 | 22.72 | 507.19 | 211.84 |
| 8.5 | 13.38 | 6.19 | 76.194 | 62.604 | 8.76 | 22.46 | 514.26 | 213.91 |
| 9 | 13.38 | 6.14 | 76.392 | 62.802 | 8.63 | 22.20 | 521.78 | 216.12 |
| 9.5 | 13.38 | 6.07 | 76.68 | 63.09 | 8.45 | 21.81 | 532.89 | 219.41 |
| 10 | 13.32 | 6.02 | 76.878 | 63.288 | 8.32 | 21.55 | 540.67 | 221.72 |
| 10.5 | 13.32 | 5.96 | 77.121 | 63.468 | 8.17 | 21.32 | 550.35 | 223.85 |
| 11 | 13.32 | 5.96 | 77.364 | 63.774 | 8.03 | 20.92 | 560.18 | 227.57 |
| 11.5 | 13.32 | 5.91 | 77.607 | 63.972 | 7.88 | 20.67 | 570.16 | 230.03 |
| 12 | 13.32 | 5.84 | 77.805 | 64.161 | 7.77 | 20.42 | 578.40 | 232.42 |
| 12.5 | 13.38 | 5.84 | 78.093 | 64.503 | 7.61 | 19.99 | 590.55 | 236.86 |

TABLE 3-continued

Results of measurements of average sublimation interface temperature Ts during flow path opening vacuum control
(2010.11.09-10 Mannitol 10% 3 mL/Vial Th = −10° C. P = 13.3 Pa)

| Time | Sublimation load(Kg/hr) | | c | Sublimation Interface pressure | Sublimation Interface Temperature | Measured Product temperature |
|---|---|---|---|---|---|---|
| (hr) | Qm1(0 s) | Qm2(120 s) | Qm1/Qm2 | Ps(Pa) | Ts(° C.) | Tm(° C.) |
| 0.5 | 0.138 | 0.170 | 0.81 | 29.15 | −32.5 | −30.1 |
| 1 | 0.137 | 0.163 | 0.84 | 34.02 | −31.1 | −28.6 |
| 1.5 | 0.131 | 0.153 | 0.86 | 37.75 | −30.1 | −27.7 |
| 2 | 0.126 | 0.147 | 0.86 | 38.47 | −29.9 | −26.9 |
| 2.5 | 0.123 | 0.142 | 0.86 | 41.44 | −29.2 | −26.3 |
| 3 | 0.119 | 0.136 | 0.87 | 44.32 | −28.5 | −25.7 |
| 3.5 | 0.116 | 0.131 | 0.89 | 50.34 | −27.3 | −25.3 |
| 4 | 0.113 | 0.128 | 0.88 | 48.94 | −27.6 | −24.8 |
| 4.5 | 0.111 | 0.125 | 0.89 | 50.90 | −27.2 | −24.4 |
| 5 | 0.107 | 0.121 | 0.88 | 50.82 | −27.2 | −24 |
| 5.5 | 0.104 | 0.118 | 0.88 | 49.58 | −27.4 | −23.7 |
| 6 | 0.103 | 0.115 | 0.89 | 54.31 | −26.5 | −23.4 |
| 6.5 | 0.100 | 0.111 | 0.90 | 60.81 | −25.4 | −23.1 |
| 7 | 0.099 | 0.110 | 0.89 | 57.33 | −26 | −22.9 |
| 7.5 | 0.098 | 0.108 | 0.90 | 60.90 | −25.4 | −22.6 |
| 8 | 0.095 | 0.106 | 0.89 | 57.92 | −25.9 | −22.4 |
| 8.5 | 0.094 | 0.104 | 0.90 | 60.37 | −25.5 | −22.2 |
| 9 | 0.092 | 0.102 | 0.90 | 63.01 | −25 | −22.1 |
| 9.5 | 0.090 | 0.100 | 0.91 | 66.31 | −24.5 | −21.8 |
| 10 | 0.089 | 0.098 | 0.91 | 66.73 | −24.5 | −21.7 |
| 10.5 | 0.087 | 0.096 | 0.91 | 67.70 | −24.3 | −21.5 |
| 11 | 0.086 | 0.094 | 0.91 | 66.97 | −24.4 | −21.4 |
| 11.5 | 0.084 | 0.092 | 0.91 | 68.74 | −24.2 | −21.3 |
| 12 | 0.083 | 0.091 | 0.92 | 74.34 | −23.4 | −21.1 |
| 12.5 | 0.082 | 0.089 | 0.92 | 76.56 | −23.1 | −21 |

As is obvious from Table 3, the following findings were obtained.

(1) When 1 hour elapsed from the start of drying, the opening angle θ of the opening adjustment device C was rotated in the opening direction for 120 seconds to change the angle θ from 70.794° to 57.195° and change the degree of vacuum Pdc in the drying chamber DC from 13.31 Pa to 7.53 Pa. The calculated sublimation interface temperature Ts was −31.1° C. The measured product temperature Tb was −28.6° C. The sublimation rate Qm was 0.137 Kg/hr.

(2) When 1 hour and 30 minutes elapsed from the start of drying, the opening angle θ of the opening adjustment device C was changed from 71.37° to 57.78° and the degree of vacuum Pdc in the drying chamber DC was changed from 13.26 Pa to 7.26 Pa. The calculated sublimation interface temperature Ts was −30.1° C. The measured product temperature Tb was −27.7° C. The sublimation rate Qm was 0.131 Kg/hr.

(3) When 5 hours elapsed from the start of drying, the opening angle θ of the opening adjustment device C was changed from 74.349° to 60.705° and the degree of vacuum Pdc in the drying chamber DC was changed from 13.32 Pa to 6.52 Pa. The calculated sublimation interface temperature Ts was −27.2° C. The measured product temperature Tb was −24.0° C. The sublimation rate Qm was 0.107 Kg/hr.

(4) When 10 hours elapsed from the start of drying, the opening angle θ of the opening adjustment device C was changed from 76.878° to 63.288° and the degree of vacuum Pdc in the drying chamber DC was changed from 13.32 Pa to 6.02 Pa. The calculated sublimation interface temperature Ts was −24.5° C. The measured product temperature Tb was −21.7° C. The sublimation rate Qm was 0.089 Kg/hr.

The calculated sublimation interface temperature Ts was about 2.1 to 3.5° C. lower than the measured product temperature. This temperature difference is equivalent to the temperature difference between the sublimation interface temperature Ts and a container bottom part temperature Tb.

As described above, the calculation method and calculation device according to the present embodiment rotates the opening angle θ of the opening adjustment device C in the opening direction at fixed time intervals during the primary drying period with respect to a vacuum control value in order to change the degree of vacuum in the drying chamber DC in the increasing direction. Hence, it is demonstrated that the average sublimation interface temperature of the whole to-be-dried material, the average bottom part temperature, and the sublimation rate can be calculated by measuring the opening angle θ of the opening adjustment device C, the degree of vacuum Pdc in the drying chamber DC, and the degree of vacuum Pct in the cold trap CT before and after the change in the degree of vacuum. Therefore, the end point of primary drying can be monitored more accurately and safely than when the product temperature of the to-be-dried material introduced into the drying chamber DC is directly measured with a temperature sensor. Further, the product temperature (measured value) decreases by approximately 0.5° C. during a period during which the opening adjustment device C is rotated in the opening direction. In marked contrast to the conventional MTM method, the present embodiment does not raise the sublimation interface temperature of the to-be-dried material by degrading the degree of vacuum in the drying chamber when the sublimation interface temperature Ts is calculated. Hence, it is demonstrated that the risk of collapsing the to-be-dried material can be completely avoided.

Second Embodiment

The calculation method and calculation device according to a second embodiment are applied to a freeze-drying device of a leak vacuum control type that includes a leak valve for adjusting the degree of vacuum in the drying chamber. The leak valve is disposed in the drying chamber.

Figure 6:
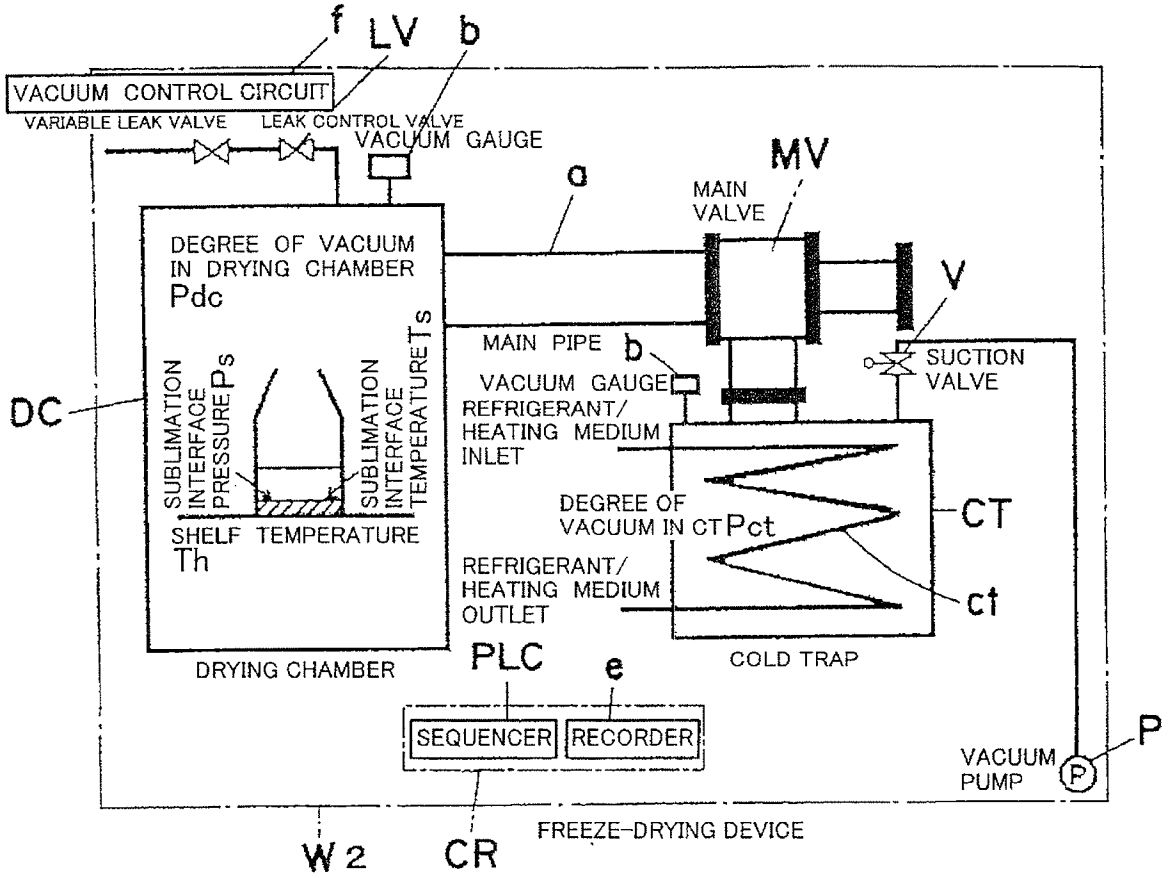
FIG. 6 is a diagram illustrating the configuration of a freeze-drying device to which a calculation method and calculation device for a leak type vacuum control system according to a second embodiment are applied.

More specifically, as shown in FIG. 6, a vacuum-drying device W2 according to the second embodiment mainly includes a drying chamber DC into which a to-be-dried material is introduced, a cold trap CT for condensing and trapping water vapor generated from the to-be-dried material introduced into the drying chamber DC by using a trap coil Ct, a main pipe a for providing communication between the drying chamber DC and the cold trap CT, a main valve MV for opening and closing the main pipe a, a vacuum control circuit f with a leak control valve LV connected to the drying chamber DC, a suction valve V annexed to the cold trap CT, a vacuum pump P connected to the suction valve V, a vacuum gauge b for detecting an absolute pressure in the drying chamber DC and an absolute pressure in the cold trap CT, and a control device CR for automatically controlling the operations of the above-mentioned elements. In the present embodiment, a control panel having a sequencer PLC and a recorder e is used as the control device CR. The sequencer PLC stores in advance a required calculation program and a relational expression that describes the relationship between the sublimation rate Qm under water load in a state where the main valve MV is fully open and the coefficient Cr of water vapor flow resistance in the main pipe a. In the other respects, the freeze-drying device W2 according to the present embodiment is the same as the freeze-drying device W1 according to the first embodiment. Therefore, like elements are designated by the same reference signs and will not be redundantly described.

Figure 7:
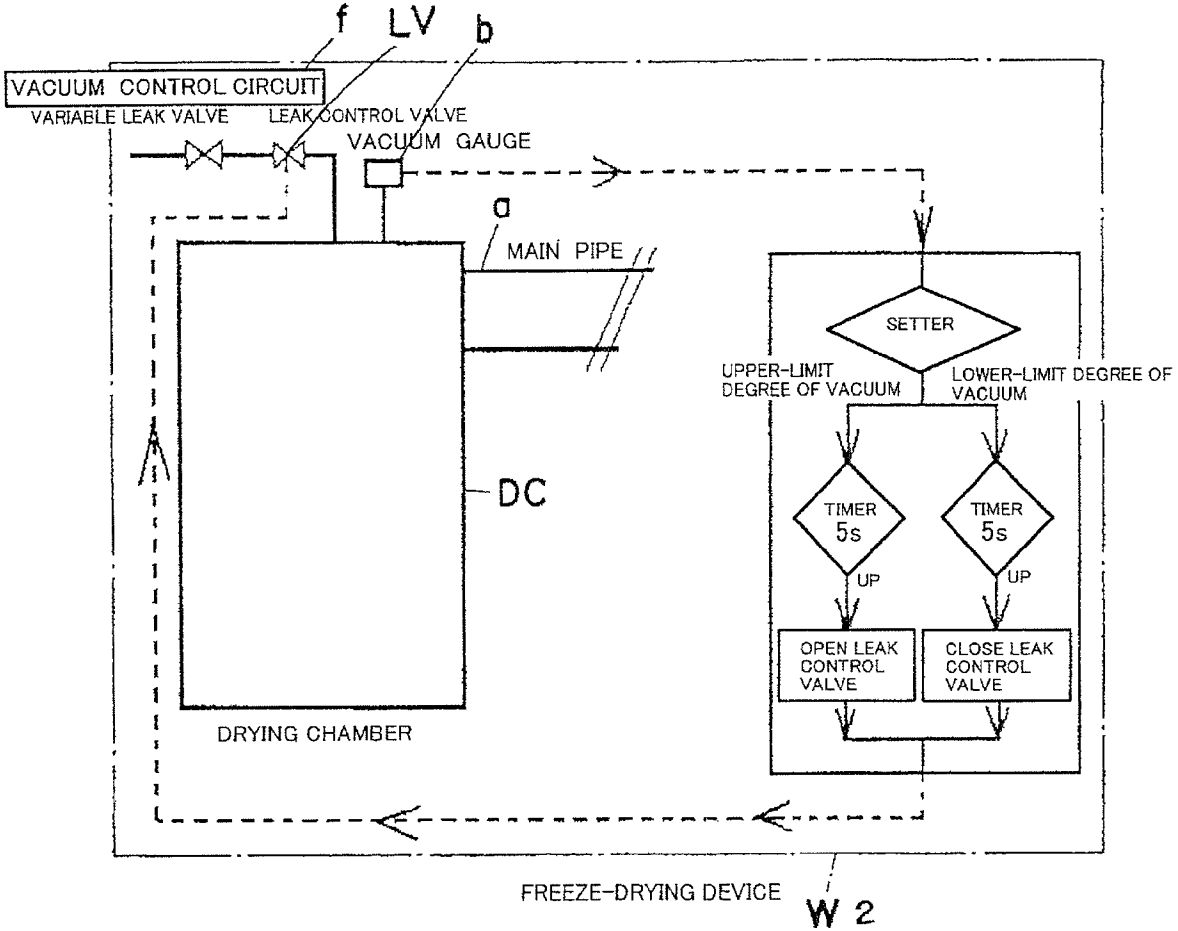
FIG. 7 is a flowchart illustrating the leak vacuum control system.

When an average sublimation interface temperature Ts, average bottom part temperature Tb, and sublimation rate Qm of the to-be-dried material introduced into the drying chamber DC during a primary drying period are to be calculated, the control device CR closes the leak control valve LV at least once and keeps it closed for several tens of seconds during the primary drying period as shown in FIG. 7 in order to change the degree of vacuum Pdc in the drying chamber DC in an increasing direction during each operation, records, with the recorder e, measured data about the degree of vacuum Pdc in the drying chamber DC and the degree of vacuum Pct in the cold trap CT before and after the leak control valve LV is closed, allows the sequencer (PLC) to acquire the measured data, and calculates the average sublimation interface temperature Ts, the average bottom part temperature Tb, and the sublimation rate Qm of the whole to-be-dried material.

<Method of Calculating the Average Sublimation Interface Temperature Ts and the Average Bottom Part Temperature Tb>

The method of calculating the average sublimation interface temperature Ts and the average bottom part temperature Tb is the same as described in conjunction with the first embodiment and will not be redundantly described.

<Method of Calculating the Sublimation Rate Qm>

As is the case with the method of calculating the sublimation rate Qm in accordance with the first embodiment, the method of calculating the sublimation rate Qm in accordance with the second embodiment calculates the sublimation rate Qm from the degree of vacuum Pdc in the drying chamber DC of the freeze-drying device W2 and the degree of vacuum Pct in the cold trap, which are respectively measured with a vacuum gauge b annexed to the drying chamber DC and with a vacuum gauge b annexed to the cold trap CT. Using this method eliminates the necessity of providing an expensive measuring instrument other than the vacuum gauge. Therefore, the sublimation rate Qm can be calculated easily at a low cost.

The method of calculating the sublimation rate Qm in accordance with the second embodiment will now be described.

As described earlier, the water vapor sublimated from the sublimation interface of the to-be-dried material flows from the drying chamber DC to the cold trap CT through the main pipe a and is condensed and trapped by the trap coil Ct. When leak vacuum control is exercised, the flow of water vapor in the main pipe a is a viscous flow. Therefore, the rate Qm of sublimation from the to-be-dried material can be calculated from the following equation.

$$Qm=3.6\times(Pdc-Pct)/R=3.6\times\Delta P/R$$

where Pdc is the degree of vacuum in the drying chamber DC (drying chamber's degree of vacuum), Pct is the degree of vacuum in the cold trap CT (cold trap's degree of vacuum), ΔP is the pressure difference between the drying chamber's degree of vacuum Pdc and the cold trap's degree of vacuum Pct, and R is the main pipe resistance.

The pressure difference ΔP is expressed as follows from an equation for calculating the pipe line pressure drop of a viscous flow.

$$\Delta P=Cr/2\times\rho\times u^2=Cr/2\times\rho\times[Qm/(3600\times A\times\rho)]^2$$

where Cr is a water vapor flow resistance coefficient of a main pipe flow path, ρ is a value expressed by the equation of state for perfect gas ρ=P×M/(R×T) (where P is the pressure of gas, M is the molecular weight of gas, R is the constant of gas, and T is the temperature of gas), and A is the flow path area of the main pipe a.

When the equation of state for perfect gas ρ=P×M/(R×T), the molecular weight of gas M=18, the constant of gas R=8314, the temperature of gas T=288, and ΔP=Pdc−Pct are substituted into the above ΔP equation and the resulting equation is converted to the equation of sublimation rate Qm, the following equation is obtained.

$$Qm=A\times[(Pdc^2-Pct^2)/(8314\times288/(18\times36002)\times Cr)]^{1/2}$$

Thus, if the sublimation rate of the to-be-dried material is Qm1 before the leak control valve LV is closed to change the degree of vacuum in the drying chamber DC in the increasing direction, Qm1 is expressed by the following equation.

$$Qm1=A\times[(Pdc1^2-Pct1^2)/(0.0103\times Cr)]^{1/2}$$

Further, if the sublimation rate of the to-be-dried material is Qm2 after the leak control valve LV is closed to change the degree of vacuum in the drying chamber DC in the increasing direction, Qm2 is expressed by the following equation.

$$Qm2=A\times[(Pdc2^2-Pct2^2)/(0.0103\times Cr)]^{1/2}$$

<Derivation of the Relational Expression Between the Sublimation Rate Qm and the Water Vapor Flow Resistance Coefficient Cr of the Main Pipe Flow Path>

The water vapor flow resistance coefficient Cr of the main pipe flow path can be determined by two different methods. One method is to measure the actual amount of sublimation under water load. The other method is to perform calculations.

When the method of calculation is used, the water vapor flow resistance coefficient Cr of the main pipe flow path can be determined from the aforementioned equation $Qm=A\times[(Pdc^2-Pct^2)/(8314\times288/(18\times36002)\times Cr)]^{1/2}$ because the flow path area A of the main pipe a is already known. When the water vapor flow resistance coefficient Cr of the main pipe flow path is determined, the sublimation rate Qm can be calculated by measuring the drying chamber's degree of vacuum Pdc and the cold trap's degree of vacuum Pct. To measure the drying chamber's degree of vacuum Pdc and the cold trap's degree of vacuum Pct, it is necessary that a high-precision vacuum gauge b be installed.

In other words, when the sublimation rate Qm is low, the pressure difference ΔP=Pdc−Pct between the drying chamber's degree of vacuum Pdc and the cold trap's degree of vacuum Pct is small. Hence, if the accuracy of the vacuum gauge b is not adequately high, Pdc may be lower than Pct. In some cases, therefore, the sublimation rate may not be calculated due to a situation where ΔP<0 and the sublimation rate Qm<0.

To avoid the above problem, it is preferred that a differential vacuum gauge be installed instead of the vacuum gauge b between the drying chamber DC and the cold trap CT to directly measure the pressure difference ΔP between the drying chamber's degree of vacuum Pdc and the cold trap's degree of vacuum Pct.

More specifically, when the freeze-drying device W2 shown in FIG. 6 is activated with the to-be-dried material introduced into the drying chamber DC to perform a drying process with the shelf temperature set at Th and with the degree of vacuum Pdc in the drying chamber set to a control value by opening or closing the leak control valve LV, the leak control valve LV is automatically closed for several tens of seconds at fixed time intervals (at intervals of 0.5 or 1 hour) during the primary drying period of the to-be-dried material. When the leak control valve LV is closed, the degree of vacuum Pdc in the drying chamber DC and the degree of vacuum Pct in the cold trap CT both change in the increasing direction. Therefore, the degree of vacuum Pdc in the drying chamber DC and the cold trap's degree of vacuum Pct are recorded before and after the leak control valve LV is closed. The recorded measured data is acquired by the sequencer (PLC). The following steps are then performed in accordance with the calculation program stored in the sequencer (PLC) to calculate the average sublimation interface temperature Ts, the average bottom part temperature Tb, and the sublimation rate Qm of the whole to-be-dried material.

(1) The average degree of vacuum Pdc1 in the drying chamber DC and the average degree of vacuum Pct1 in the cold trap CT for a period of first 3 seconds after the leak control valve LV is closed are calculated. Further, the average degree of vacuum Pdc2 in the drying chamber DC and the average degree of vacuum Pct2 in the cold trap CT for a period of 3 seconds after the leak control valve LV has been closed for 10 seconds are calculated.

(2) In accordance with the relational expression between the water vapor flow resistance coefficient Cr of the main pipe a, which is measured under water load, and the sublimation rate Qm, the sequencer (PLC) acquires the value of the water vapor flow resistance coefficient Cr and the cross-sectional area A of the main pipe flow path before and after the leak control valve LV is opened/closed.

(3) In accordance with the equation for calculating the pipe line pressure drop of a viscous flow $\Delta P=Cr/2\times\rho\times u^2=Cr/2\times\rho\times[Qm/(3600\times A\times\times)]^2$, the sublimation rate Qm1 prevailing before the closing of the leak control valve LV, the sublimation rate Qm2 prevailing after the closing of the leak control valve LV, and the ratio between the above two values are calculated from the following equations.

$$Qm1=A\times[(Pdc1^2-Pct1^2)/(0.0103\times Cr)]^{1/2}$$

$$Qm2=A\times[(Pdc2^2-Pct2^2)/(0.0103\times Cr)]^{1/2}$$

$$C=Qm1/Qm2$$

(4) Next, in accordance with the results of the above calculations, the sublimation interface pressure Ps of the to-be-dried material is calculated from the following equation.

$$Ps=[C\times(Pdc2+\Delta Ps)-Pdc1]/(C-1)$$

where ΔPs is a decrease in the sublimation interface pressure that is caused when the sublimation interface temperature decreases while the leak control valve LV is closed, and is determined when the sublimation interface temperature decrease ΔTs caused by closing the leak control valve LV is substituted into the equation $\Delta Ps/Ps=6144.96\times\Delta Ts/Ts^2$, which is obtained when the Clausius-Clapeyron equation LnPs=28.91-6144.96/Ts is differentiated. It should be noted that the sublimation interface temperature decrease ΔTs caused by closing the leak control valve LV for 10 seconds is small.

(5) A constant of ice is substituted into the Clausius-Clapeyron equation to determine the sublimation interface temperature Ts=6144.96/(28.911−LnPs)−273.15.

(6) The sublimation rate $Qm=A\times[(Pdc1^2-Pct1^2)/(0.0103\times Cr)]^{1/2}$ is calculated.

(7) The bottom part temperature Tb=[K×Th+Kr×Tw−(Qm×ΔHs)/(3.6×Ae)]/(K+Kr) is calculated.

Next, the flow resistance coefficient Cr of the water vapor flowing through the main pipe a, which communicates the drying chamber DC to the cold trap CT, is determined. The flow resistance coefficient Cr of the water vapor is the sum of water vapor flow resistance coefficients of various sections between the inlet and outlet of the main pipe a. In the current test example, the main pipe a was divided into five sections, namely, a main pipe inlet, a main pipe outlet, an elbow portion, a location where the main valve MV is installed, and a section having a fully developed flow and excluding an inlet section of the main pipe a (an entrance region of the flow of water vapor). Further, the flow resistance coefficient Cr1 of the main pipe inlet was 0.5, the flow resistance coefficient Cr2 of the main pipe outlet was 0.5, the flow resistance coefficient Cr3 of the elbow portion was 1.2, and the flow resistance coefficient Cr4 of the location where the main valve MV is installed was 1.7.

Figure 8:
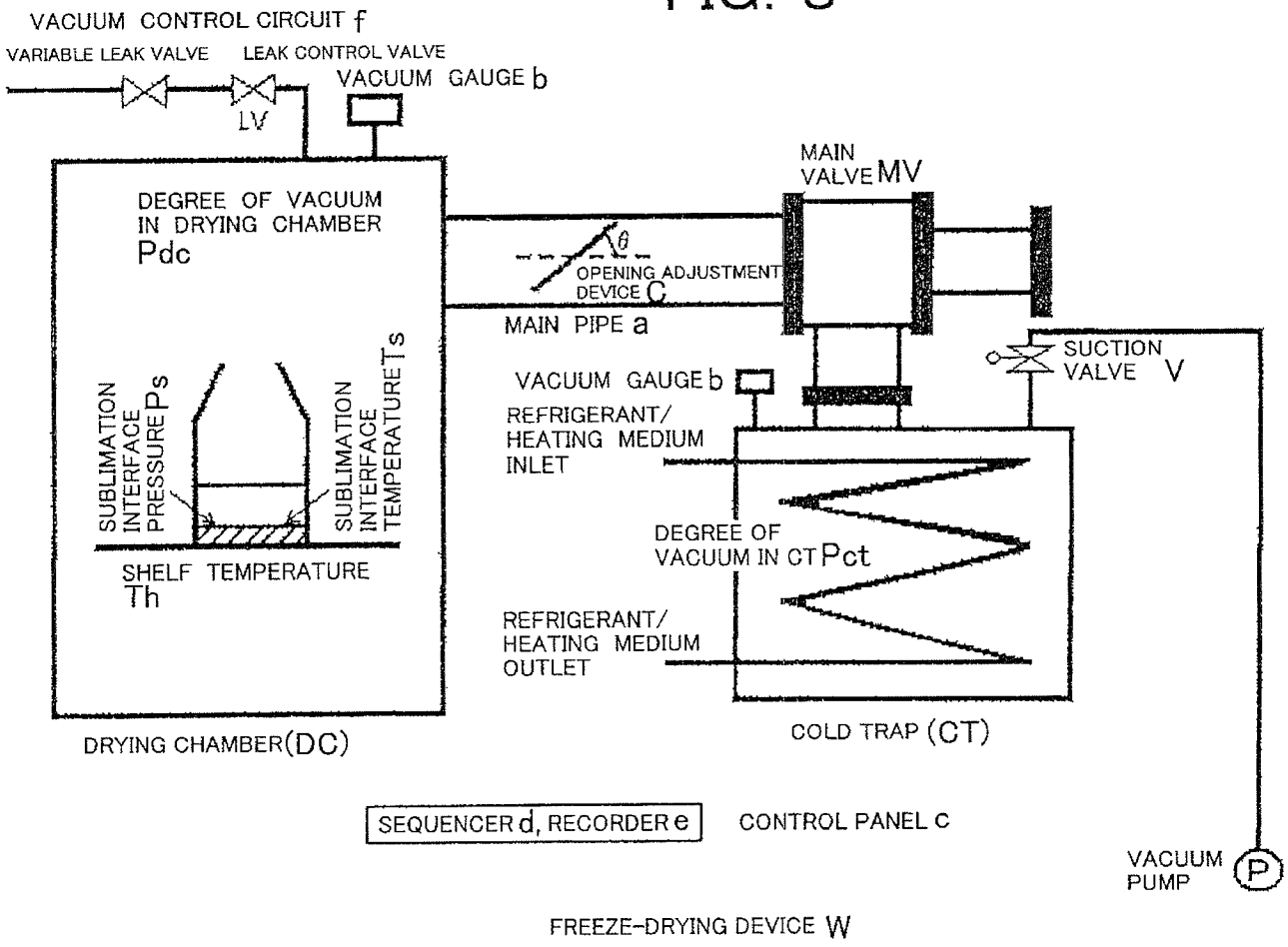
FIG. 8 is a diagram illustrating the configuration of an experimental machine that is used to calculate the sublimation interface temperature, bottom part temperature, and sublimation rate of the to-be-dried material.

The flow resistance coefficient Cr3 of the elbow portion is determined from the equation 1.13×n (90°×n places). As shown in FIG. 8, the freeze-drying device used in the current test example includes the leak valve LV, which is disposed in the drying chamber to adjust the degree of vacuum in the drying chamber DC, in addition to the opening adjustment device C, which is disposed in the main pipe a for connecting the drying chamber DC to the cold trap CT. Therefore, Cr3=1.2 as it represents a flow resistance corresponding to the elbow.

The flow resistance coefficient Cr5 of the section having a fully developed flow and excluding the inlet section of the main pipe a (the entrance region of the flow of water vapor) is determined from the equation $Cr5=\lambda\times L/D+\xi$ (where ξ=2.7, L is the length of the main pipe, D is the inside diameter of the main pipe, and λ is a friction coefficient). The friction coefficient λ is determined from the equation λ=64/Re (where Re is the Reynolds number). The Reynolds number Re is determined from the equation $Re=u\times D/\nu\approx 40\times Qm/D$ (where Qm is the sublimation rate and D is the inside diameter of the main pipe a).

In the test machine used in the current example, Cr=6.6+1.6×0.7/0.17=13.19 when L=0.7 m and Qm=0.17 Kg/hr.

Meanwhile, when the relational expression between the sublimation rate Qm and the water vapor flow resistance coefficient Cr of the main pipe flow path is to be determined by making measurements, the procedure to be followed includes mounting a product temperature sensor on the bottom part of a tray, pouring water into the tray, freezing to a temperature of −40° C., setting the shelf temperature during the primary drying period, exercising control to sequentially change the degree of vacuum in the drying chamber from 26.7 Pa to 6.7 Pa, measuring the shelf temperature Th and the bottom part temperature Tb, and recording the degree of vacuum Pdc in the drying chamber DC and the degree of vacuum Pct in the cold trap CT by using an absolute vacuum gauge.

The sublimation rate Qm (Kg/hr) can be determined by two different methods. One method is to determine the amount of sublimation from the difference between the weight of the to-be-dried material before sublimation and the weight of the to-be-dried material after sublimation. The other method is to make an analysis in accordance with a calculated amount of heat input. When the analysis is to be made, the method calculates the coefficient $\alpha$ of heat transfer from the shelf to the tray bottom part in accordance with the degree of vacuum Pdc in the drying chamber DC, calculates the amount of heat flow to the tray bottom part by using the equation $Q=A1\times\alpha\times(Th-Tb)$, and determines the sublimation rate Qm from the equation $Qm=Q/2850$ as the latent heat of sublimation of ice is 2850 KJ/Kg. This makes it possible to obtain the relational expression between the water vapor flow resistance coefficient Cr of the main pipe flow path and the sublimation rate Qm.

As far as the degree of vacuum Pdc in the drying chamber and the degree of vacuum Pct in the CT are measured and recorded when a freeze-drying program is actually set to freeze-dry the to-be-dried material, the execution of leak vacuum control according to the present embodiment makes it possible to determine the flow rate of water vapor sublimated during the primary drying period and calculate the sublimation rate by using the relational expression between the sublimation rate Qm and the water vapor resistance coefficient Cr of the main pipe flow path, which is derived from a water load measurement.

Second Embodiment

The calculation method and calculation device for the sublimation interface temperature and the sublimation rate of the to-be-dried material that are applied to the freeze-drying device W2 of the leak vacuum control type will now be described in further detail.

<Derivation of the Relational Expression Between the Water Vapor Flow Resistance Coefficient Cr and the Sublimation Rate Qm>

First of all, a water load test was conducted to obtain the relational expression between the water vapor flow resistance coefficient Cr of the main pipe flow path and the sublimation rate Qm. In the water load test, a tray filled with water was introduced into the drying chamber DC, and the freeze-drying device W2 was operated under the control of the control device CR to perform a predetermined drying process. In the present embodiment, when the primary drying process was performed after the water in the tray was frozen to a temperature of −45° C., the shelf temperature Th was set to −20° C., the degree of vacuum Pdc in the drying chamber DC was set to 6.7 Pa, and the resulting state was maintained for 3 hours. Further, control was exercised to set the shelf temperature Th to −10° C. and set the degree of vacuum Pdc in the drying chamber DC to 6.7 Pa, 13.3 Pa, and 20 Pa in sequence. Each of the resulting states was maintained for 3 hours. Furthermore, control was exercised to set the shelf temperature Th to 5° C. and set the degree of vacuum Pdc in the drying chamber DC to 6.7 Pa and 13.3 Pa in sequence. Each of the resulting states was maintained for 3 hours. Moreover, control was exercised to set the shelf temperature Th to 20° C. and set the degree of vacuum Pdc in the drying chamber DC to 6.7 Pa and 13.3 Pa in sequence. Each of the resulting states was maintained for 3 hours. When the water load test was conducted under the above-described nine different sets of conditions, the shelf temperature Th, the tray bottom part temperature Tb, the drying chamber's degree of vacuum Pdc, and the cold trap's degree of vacuum Pct were measured and recorded. In addition, the sublimation rate Qm (Kg/h) of ice and the water vapor flow resistance coefficient Cr of the main pipe flow path were determined from the above measurement results. Table 4 shows the shelf temperature Th, the drying chamber's degree of vacuum Pdc, the cold trap's degree of vacuum Pct, the sublimation rate Qm, and the water vapor flow resistance coefficient Cr that were determined by the water load test.

TABLE 4

Relationship between sublimation load Qm (Kg/h) and water vapor flow resistance coefficient Cr of main pipe flow path

| Shelf temperature Th (° C.) | Drying chamber vacuum Pdc (Pa) | CT vacuum Pct (Pa) | Sublimation load Qm (kg/h) | Water vapor flow resistance coefficient Cr |
|---|---|---|---|---|
| −20 | 7.03 | 6.24 | 0.144 | 15.19 |
| −10 | 7.04 | 6.05 | 0.172 | 13.16 |
| −10 | 13.55 | 12.97 | 0.197 | 11.99 |
| −10 | 20.23 | 19.86 | 0.191 | 12.22 |
| 5 | 7.04 | 5.28 | 0.254 | 10.1 |
| 5 | 13.55 | 12.58 | 0.282 | 9.77 |
| 5 | 13.55 | 12.55 | 0.291 | 9.26 |
| 20 | 7.04 | 4.47 | 0.317 | 8.8 |
| 20 | 13.55 | 12.09 | 0.374 | 8.05 |

Figure 9:
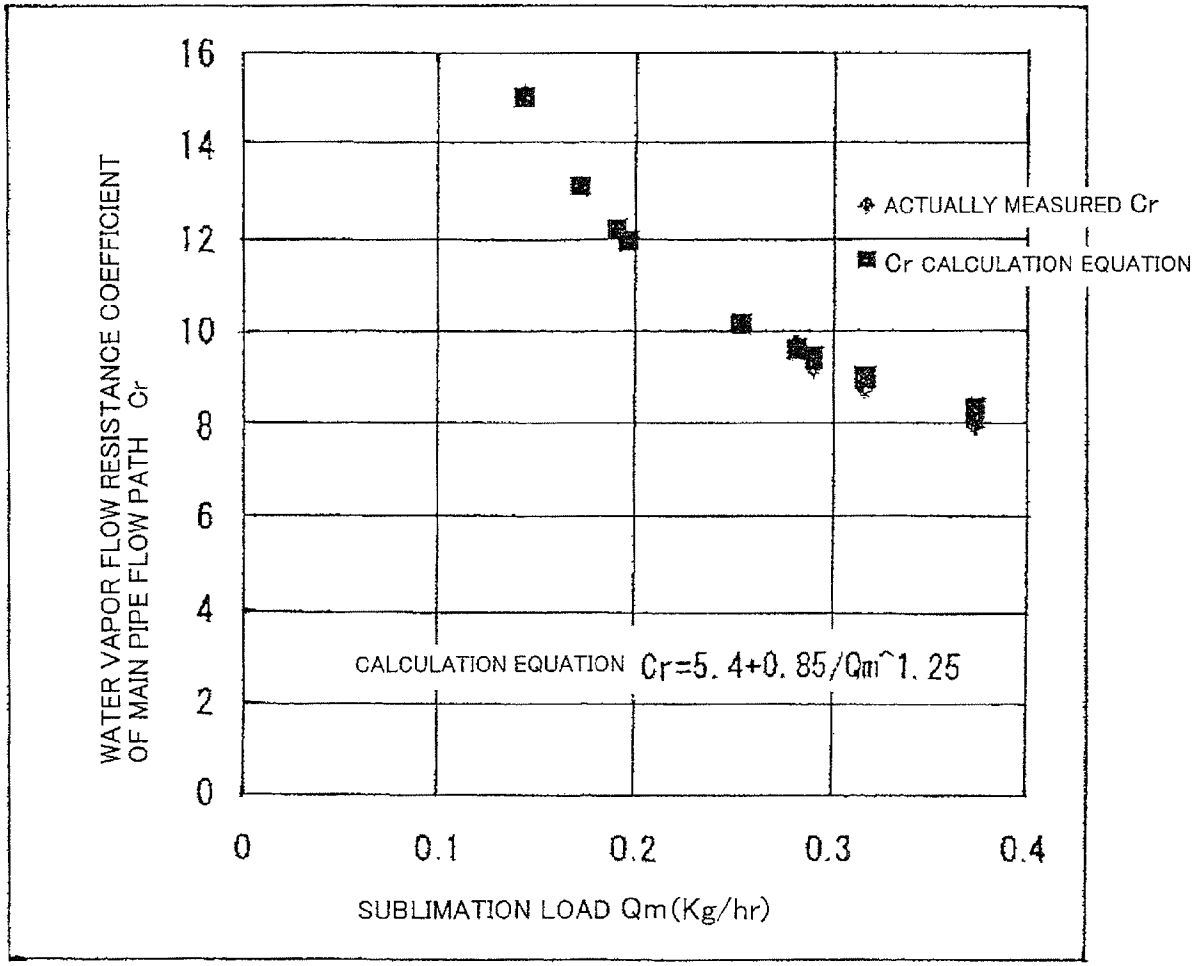
FIG. 9 is a graph illustrating the water-load-dependent relationship to a water vapor flow resistance coefficient Cr of a main pipe flow path that is determined by the calculation method and calculation device for the leak vacuum control system according to the second embodiment.

FIG. 9 is a graph that is prepared in accordance with the data in Table 4 to illustrate the relationship between the water vapor flow resistance coefficient Cr of the main pipe flow path and the sublimation rate Qm. From this graph, the following relational expression is obtained.

$$Cr=5.4+0.85/Qm^{1.25}$$

In the present embodiment, the main pipe a is relatively short so that the whole main pipe a is an inlet section (an entrance region). Therefore, when compared to the equation $Cr=6.6+1.6\times L/Qm$ for a section having a fully developed flow of water vapor, the water vapor flow resistance coefficient Cr is inversely proportional to the sublimation rate $Qm^{1.25}$.

<Calculation of the Average Sublimation Interface Temperature Ts and Sublimation Rate Qm of the to-be-Dried Material>

Outside air was introduced into the freeze-drying device W2 through a variable leak valve and leak control valve LV included in the vacuum control circuit f to maintain the degree of vacuum Pdc in the drying chamber DC at 13.3 Pa. Subsequently, the leak control valve LV was closed for 40 seconds at 30-minute intervals. While the leak control valve LV was closed, the drying chamber's degree of vacuum Pdc and the cold trap's degree of vacuum Pct were measured and recorded. The average sublimation interface temperature Ts and sublimation rate Qm of the to-be-dried material were then measured with calculation software stored in the sequencer PLC. Table 5 shows the results of the measurements.

TABLE 5

Results of measurements of average sublimation interface temperature Ts during leak control (2010.11.18-19 Mannitol 10% 3 mL/Vial Th = −10° C. P = 13.3 Pa)

| Leak valve closed | Drying chamber vacuum Pdc(Pa) | CT vacuum Pct(Pa) | Sublimation rate Qm(kg/hr) | Resistance coefficient Cr | C Qm1/Qm2 | Sublimation interface pressure Ps(Pa) | Sublimation interface Temperature Ts = Calculated Ts | Measured Product temperature |
|---|---|---|---|---|---|---|---|---|
| | | | | 12:15 | | | | |
| 0 s | 12.926 | 12.580 | 0.133 | 15.022 | 0.900 | 33.751 | −31.1 | −28.7 |
| 10 s | 10.604 | 10.106 | 0.148 | 14.177 | | | | |
| | | | | 12.43 | | | | |
| 0 s | 13.369 | 12.977 | 0.148 | 14.180 | 0.908 | 35.957 | −30.5 | −27.9 |
| 10 s | 11.066 | 10.515 | 0.163 | 13.478 | | | | |
| | | | | 13.18 | | | | |
| 0 s | 13.333 | 12.960 | 0.143 | 14.436 | 0.924 | 42.037 | −29 | −26.9 |
| 10 s | 10.955 | 10.440 | 0.155 | 13.837 | | | | |
| | | | | 13.48 | | | | |
| 0 s | 13.315 | 12.902 | 0.153 | 13.925 | 0.932 | 48.453 | −27.7 | −26.2 |
| 10 s | 10.769 | 10.195 | 0.164 | 13.430 | | | | |
| | | | | 14.21 | | | | |
| 0 s | 13.502 | 13.129 | 0.144 | 14.368 | 0.938 | 48.049 | −27.7 | −25.6 |
| 10 s | 11.218 | 10.720 | 0.154 | 13.886 | 3.559 | 48.049 | | |
| | | | | 14.52 | | | | |
| 0 s | 13.246 | 12.846 | 0.149 | 14.115 | 0.944 | 52.391 | −26.9 | −25.1 |
| 10 s | 10.920 | 10.386 | 0.158 | 13.693 | | | | |
| | | | | 15:20 | | | | |
| 0 s | 12.580 | 12.180 | 0.144 | 14.388 | 0.945 | 50.917 | −27.2 | −24.7 |
| 10 s | 10.353 | 9.820 | 0.152 | 13.961 | | | | |
| | | | | 15.46 | | | | |
| 0 s | 13.142 | 12.769 | 0.142 | 14.515 | 0.936 | 51.469 | −27.1 | −24.6 |
| 10 s | 10.511 | 9.991 | 0.151 | 14.006 | | | | |
| | | | | 16:20 | | | | |
| 0 s | 12.860 | 12.486 | 0.139 | 14.637 | 0.941 | 54.827 | −26.4 | −24.5 |
| 10 s | 10.209 | 9.689 | 0.148 | 14.159 | | | | |
| | | | | 16:48 | | | | |
| 0 s | 13.333 | 12.960 | 0.143 | 14.436 | 0.944 | 60.679 | −25.4 | −24.4 |
| 10 s | 10.529 | 10.009 | 0.151 | 13.998 | | | | |
| | | | | 17:24 | | | | |
| 0 s | 13.366 | 13.020 | 0.136 | 14.827 | 0.945 | 54.483 | −26.5 | −24.2 |
| 10 s | 10.973 | 10.511 | 0.144 | 14.374 | | | | |
| | | | | 17:51 | | | | |
| 0 s | 13.140 | 12.793 | 0.135 | 14.925 | 0.945 | 59.564 | −25.6 | −24.2 |
| 10 s | 10.413 | 9.933 | 0.142 | 14.463 | | | | |

(1) When 35 minutes elapsed from the start of drying, the leak control valve LV was closed for 40 seconds. For a period of first 3 seconds after the closure of the leak control valve LV, the drying chamber's average degree of vacuum Pdc was 12.926 Pa and the cold trap's average degree of vacuum Pct was 12.580 Pa. Further, for a 3-second period after the instant at which 10 seconds elapsed from the closure of the leak control valve LV, the drying chamber's average degree of vacuum Pdc was 10.604 Pa and the cold trap's average degree of vacuum Pct was 10.106 Pa. As a result, the sublimation interface temperature Ts calculated from the above measured data was −31.1° C., the sublimation rate Qm changed from 0.133 Kg/hr to 0.148 Kg/hr, and the measured product temperature Tb was −28.7° C.

(2) When 1 hour and 3 minutes elapsed from the start of drying, the leak control valve LV was closed for 40 seconds. For a period of first 3 seconds after the closure of the leak control valve LV, the drying chamber's average degree of vacuum Pdc was 13.369 Pa and the cold trap's average degree of vacuum Pct was 12.977 Pa. Further, for a 3-second period after the instant at which 10 seconds elapsed from the closure of the leak control valve LV, the drying chamber's average degree of vacuum Pdc was 11.066 Pa and the cold trap's average degree of vacuum Pct was 10.515 Pa. As a result, the sublimation interface temperature Ts calculated from the above measured data was −30.5° C., the sublimation rate Qm changed from 0.148 Kg/hr to 0.163 Kg/hr, and the measured product temperature Tb was −27.9° C.

(3) When 2 hours and 8 minutes elapsed from the start of drying, the leak control valve LV was closed for 40 seconds. For a period of first 3 seconds after the closure of the leak control valve LV, the drying chamber's average degree of vacuum Pdc was 13.315 Pa and the cold trap's average degree of vacuum Pct was 12.902 Pa. Further, for a 3-second period after the instant at which 10 seconds elapsed from the closure of the leak control valve LV, the drying chamber's average degree of vacuum Pdc was 10.769 Pa and the cold trap's average degree of vacuum Pct was 10.195 Pa. As a result, the sublimation interface temperature Ts calculated from the above measured data was −27.7° C., the sublimation rate Qm changed from 0.153 Kg/hr to 0.164 Kg/hr, and the measured product temperature Tb was −26.2° C.

(4) When 3 hours and 40 minutes elapsed from the start of drying, the leak control valve LV was closed for 40 seconds. For a period of first 3 seconds after the closure of the leak control valve LV, the drying chamber's average degree of vacuum Pdc was 12.580 Pa and the cold trap's average degree of vacuum Pct was 12.180 Pa. Further, for a 3-second period after the instant at which 10 seconds elapsed from the closure of the leak control valve LV, the drying chamber's average degree of vacuum Pdc was 10.353 Pa and the cold trap's average degree of vacuum Pct was 9.820 Pa. As a result, the sublimation interface temperature Ts calculated from the above measured data was −27.2° C., the sublimation rate Qm changed from 0.144 Kg/hr to 0.152 Kg/hr, and the measured product temperature Tb was −24.7° C.

(5) When 4 hours and 40 minutes elapsed from the start of drying, the leak control valve LV was closed for 40 seconds. For a period of first 3 seconds after the closure of the leak control valve LV, the drying chamber's average degree of vacuum Pdc was 12.860 Pa and the cold trap's average degree of vacuum Pct was 12.486 Pa. Further, for a 3-second period after the instant at which 10 seconds elapsed from the closure of the leak control valve LV, the drying chamber's average degree of vacuum Pdc was 10.209 Pa and the cold trap's average degree of vacuum Pct was 9.689 Pa. As a result, the sublimation interface temperature Ts calculated from the above measured data was −26.4° C., the sublimation rate Qm changed from 0.139 Kg/hr to 0.148 Kg/hr, and the measured product temperature Tb was −24.5° C.

As is obvious from Table 5, the calculated sublimation interface temperature Ts is about 0.6 to 1.9° C. lower than the measured product temperature. This temperature difference corresponds to the difference between the sublimation interface temperature and the container bottom part temperature.

When the leak control valve LV was closed for 40 seconds, the product temperature (measured temperature) decreased by about 0.5° C. Unlike the conventional MTM method, the present embodiment does not raise the sublimation interface temperature of the to-be-dried material by degrading the degree of vacuum in the drying chamber when the sublimation interface temperature Ts is calculated. Hence, it is demonstrated that the risk of collapsing the to-be-dried material can be completely avoided. Further, the data in Table 5 proves that the method for calculating the sublimation interface temperature of the to-be-dried material in accordance with the present invention makes it possible to accurately calculate the average sublimation interface temperature of many to-be-dried materials introduced into the drying chamber DC.

Advantages provided by the calculation method and calculation device for the sublimation interface temperature, bottom part temperature, and sublimation rate of the to-be-dried material in accordance with the present invention will now be enumerated.

Figure 10:
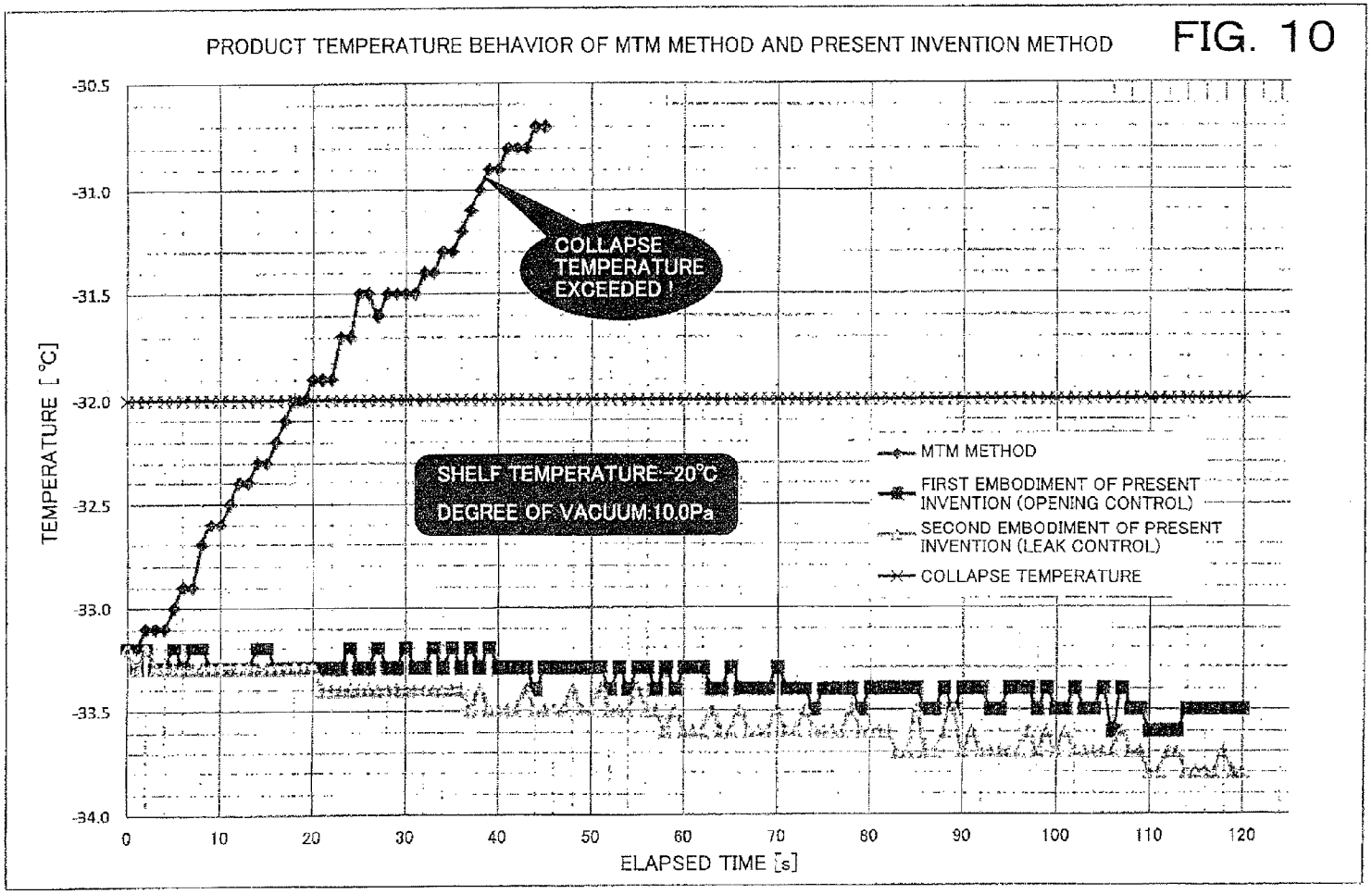
FIG. 10 is a graph illustrating the comparison of advantageous effects between the present invention and the MTM method.

As described earlier, the MTM method closes the main valve MV during the primary drying period. Therefore, the degree of vacuum in the drying chamber DC may decrease while the main valve MV is closed, thereby raising the product temperature by 1 to 2° C. This may cause the to-be-dried material to collapse. Meanwhile, the calculation method and calculation device for the sublimation interface temperature and sublimation rate of the to-be-dried material in accordance with the present invention change the degree of vacuum Pdc in the drying chamber DC in the increasing direction during the primary drying period. This makes it possible to decrease the sublimation interface temperature Ts of the to-be-dried material as shown in FIG. 10 and completely prevent the collapse of the to-be-dried material unlike the MTM method.

Further, the calculation method and calculation device for the sublimation interface temperature and sublimation rate of the to-be-dried material in accordance with the present invention make it possible to monitor the average sublimation interface temperature Ts and sublimation rate Qm of the to-be-dried material during the primary drying period without requiring human intervention. Therefore, when a pharmaceutical is formulated by using a freeze-drying device that automatically loads a raw material liquid from a filling machine to the freeze-drying device, it is possible to implement a noncontact process monitoring method called "PAT" (Process Analytical Technology), which is recommended by the United States Food and Drug Administration (FDA).

Furthermore, the calculation method and calculation device for the sublimation interface temperature and sublimation rate of the to-be-dried material in accordance with the present invention make it possible to not only calculate the average sublimation interface temperature Ts of the whole to-be-dried material during the primary drying period of a freeze-drying process without measuring the product temperature of each container, but also calculate the flow rate of water vapor sublimated from the sublimation interface, namely, the sublimation rate Qm (Kg/h). Therefore, a change curve of the sublimation rate Qm during the primary drying period is obtained. This makes it possible to monitor the drying process more properly. As regards a pharmaceutical, the amount of raw material liquid to be dispensed into a container is changed in accordance with a titer. Therefore, the length of primary drying time changes each time when a pharmaceutical exhibiting a variable titer is to be formulated. For this reason, if only the shelf temperature Th and the drying time are managed, it is difficult to determine the end of primary drying. The calculation method and calculation device for the sublimation interface temperature and sublimation rate of the to-be-dried material in accordance with the present invention make it possible to obtain the change curve of the sublimation rate Qm. Hence, the end of primary drying can be accurately determined.

Moreover, data on the water vapor transfer resistance of a dried layer can be collected by measuring the average sublimation interface temperature Ts and the sublimation rate Qm. This makes it possible to create an optimum drying program for the to-be-dried material in consideration of the collapse temperature.

INDUSTRIAL APPLICABILITY

The present invention is applicable to a freeze-drying device that is used to freeze-dry foods and pharmaceuticals.

LIST OF REFERENCE SIGNS

C . . . Opening adjustment device
CT . . . Cold trap

CR . . . Control device
DC . . . Drying chamber
MV . . . Main valve
P . . . Vacuum pump
PLC . . . Sequencer
V . . . Suction valve
W . . . Freeze-drying device
a . . . Main pipe
b . . . Vacuum gauge
ct . . . Trap coil (plate)
e . . . Recorder
f . . . Vacuum control circuit

The invention claimed is:

1. A calculation method for a sublimation interface temperature and a sublimation rate of a material to be dried in a freeze-drying device, in the calculation method for the sublimation interface temperature, a bottom part temperature, and the sublimation rate of the material to be dried in the freeze-drying device comprising: a drying chamber (DC) into which the to-be-dried material is introduced; a cold trap (CT) for condensing and trapping water vapor generated from the to-be-dried material introduced into the drying chamber (DC); a main pipe (a) for providing communication between the drying chamber (DC) and the cold trap (CT); a main valve (MV) for opening and closing the main pipe (a); vacuum adjustment means for adjusting a degree of vacuum in the drying chamber (DC); vacuum detection means for detecting an absolute pressure in the drying chamber (DC) and an absolute pressure in the cold trap (CT); and a control device (CR) for automatically controlling operations of the drying chamber (DC), of the cold trap (CT), and of the opening adjustment means, wherein the control device (CR) stores a required relational expression and a calculation program, drives the vacuum adjustment means during a primary drying period of the to-be-dried material to temporarily change the degree of vacuum (Pdc) in the drying chamber (DC) in an increasing direction, and calculates an average sublimation interface temperature, an average bottom part temperature, and the sublimation rate of the to-be-dried material that prevail during the primary drying period in accordance with the relational expression and with measured data including at least the degree of vacuum (Pdc) in the drying chamber (DC) and the degree of vacuum (Pdt) in the cold trap (CT), which are obtained before and after the temporary change.

2. The calculation method for the sublimation interface temperature, and the sublimation rate of the material to be dried in the freeze-drying device according to claim 1, wherein the main pipe (a) includes a damper-type opening adjustment device (C) as the vacuum adjustment means, and the relational expression stored in the control device describes the relationship between the sublimation rate (Qm) under water load in a state where the main valve (MV) is fully open, an opening angle (θ) of the opening adjustment device (C), and a main pipe resistance R(θ); and the control device (CR) turns the opening adjustment device (C) at least once in an opening direction during the primary drying period of the to-be-dried material introduced into the drying chamber (DC) to change the degree of vacuum (Pdc) in the drying chamber (DC) in the increasing direction, and calculates the average sublimation interface temperature, the bottom part temperature, and the sublimation rate of the to-be-dried material that prevail during the primary drying period in accordance with measured data about the opening angle (θ) of the opening adjustment device (C), the degree of vacuum (Pdc) in the drying chamber (DC), and the degree of vacuum (Pdt) in the cold trap (CT), which are obtained before and after the opening-direction turning of the opening adjustment device (C).

3. The calculation method for the sublimation interface temperature, and the sublimation rate of the material to be dried in the freeze-drying device according to claim 1, wherein the drying chamber (DC) includes a vacuum control circuit (f) with a leak control valve (LV) as the vacuum adjustment means, and the relational expression stored in the control device describes the relationship between the sublimation rate (Qm) under water load in a state where the main valve (MV) is fully open and a water vapor flow resistance coefficient (Cr) of the main pipe (a); and the control device (CR) closes the leak control valve (LV) at least once during the primary drying period of the to-be-dried material introduced into the drying chamber (DC) to change the degree of vacuum (Pdc) in the drying chamber (DC) in the increasing direction, and calculates the average sublimation interface temperature, the average bottom part temperature, and the sublimation rate of the to-be-dried material that prevail during the primary drying period in accordance with measured data about the degree of vacuum (Pdc) in the drying chamber (DC) and the degree of vacuum (Pdt) in the cold trap (CT), which are obtained before and after the closing of the leak control valve (LV).

4. A calculation device for a sublimation interface temperature and a sublimation rate of a material to be dried in a freeze-drying device, in the calculation device for the sublimation interface temperature, a bottom part temperature, and the sublimation rate of the material to be dried in the freeze-drying device comprising: a drying chamber (DC) into which the to-be-dried material is introduced; a cold trap (CT) for condensing and trapping water vapor generated from the to-be-dried material introduced into the drying chamber (DC); a main pipe (a) for providing communication between the drying chamber (DC) and the cold trap (CT); a main valve (MV) for opening and closing the main pipe (a); vacuum adjustment means for adjusting the degree of vacuum in the drying chamber (DC); vacuum detection means for detecting an absolute pressure in the drying chamber (DC) and an absolute pressure in the cold trap (CT); and a control device (CR) for automatically controlling operations of the drying chamber (DC), of the cold trap (CT), and of opening adjustment means, wherein the control device (CR) is a sequencer (PLC) or a personal computer (PC) that stores a required relational expression and a calculation program; and the control device (CR) drives the vacuum adjustment means during a primary drying period of the to-be-dried material to temporarily change the degree of vacuum (Pdc) in the drying chamber (DC) in an increasing direction, and calculates an average sublimation interface temperature, an average bottom part temperature, and the sublimation rate of the to-be-dried material that prevail during the primary drying period in accordance with the relational expression and with measured data including at least the degree of vacuum (Pdc) in the drying chamber (DC) and the degree of vacuum (Pdt) in the cold trap (CT), which are obtained before and after the temporary change.

5. The calculation device for the sublimation interface temperature, and the sublimation rate of the material to be dried in the freeze-drying device according to claim 4, wherein the main pipe (a) includes a damper-type opening adjustment device (C) as the vacuum adjustment means, in the calculation device for the sublimation interface temperature, the bottom part temperature, and the sublimation rate of the material to be dried in the freeze-drying device;

the relational expression stored in the control device (CR) describes the relationship between the sublimation rate (Qm) under water load in a state where the main valve (MV) is fully open, an opening angle (θ) of the opening adjustment device (C), and a main pipe resistance R(θ); and the control device (CR) turns the opening adjustment device (C) at least once in an opening direction during the primary drying period of the to-be-dried material introduced into the drying chamber (DC) to change the degree of vacuum (Pdc) in the drying chamber (DC) in the increasing direction, and calculates the average sublimation interface temperature, the bottom part temperature, and the sublimation rate of the to-be-dried material that prevail during the primary drying period in accordance with measured data about the opening angle (θ) of the opening adjustment device (C), the degree of vacuum (Pdc) in the drying chamber (DC), and the degree of vacuum (Pdt) in the cold trap (CT), which are obtained before and after the opening-direction turning of the opening adjustment device (C).

6. The calculation device for the sublimation interface temperature, and the sublimation rate of the material to be dried in the freeze-drying device according to claim 4, wherein the drying chamber (DC) includes a vacuum control circuit (f) with a leak control valve (LV) as the vacuum adjustment means;

the relational expression stored in the control device (CR) describes the relationship between the sublimation rate (Qm) under water load in a state where the main valve (MV) is fully open and a water vapor flow resistance coefficient (Cr) of the main pipe (a); and the control device (CR) closes the leak control valve (LV) at least once during the primary drying period of the to-be-dried material introduced into the drying chamber (DC) to change the degree of vacuum (Pdc) in the drying chamber (DC) in the increasing direction, and calculates the average sublimation interface temperature, the average bottom part temperature, and the sublimation rate of the to-be-dried material that prevail during the primary drying period in accordance with measured data about the degree of vacuum (Pdc) in the drying chamber (DC) and the degree of vacuum (Pdt) in the cold trap (CT), which are obtained before and after the closing of the leak control valve (LV).

* * * * *